US005614061A

United States Patent [19]

Van Phan et al.

[11] Patent Number: 5,614,061

[45] Date of Patent: Mar. 25, 1997

[54] APPARATUS FOR FORMING A CELLULOSIC FIBROUS STRUCTURES HAVING AT LEAST THREE REGIONS DISTINGUISHED BY INTENSIVE PROPERTIES

[75] Inventors: Dean Van Phan, Cincinnati; Paul D. Trokhan, Hamilton, both of Ohio

[73] Assignee: The Procter & Gamble Company, Cincinnati, Ohio

[21] Appl. No.: 613,797

[22] Filed: Mar. 1, 1996

Related U.S. Application Data

[63] Continuation of Ser. No. 382,551, Feb. 2, 1995, abandoned, which is a continuation of Ser. No. 71,834, Jul. 10, 1987, Pat. No. 5,443,691, which is a continuation of Ser. No. 724,551, Jun. 28, 1991, Pat. No. 5,277,761.

[51] Int. Cl.[6] ..... D21H 27/02

[52] U.S. Cl. ..... 162/109; 162/115; 162/290; 162/291; 162/362

[58] Field of Search ..... 162/289, 290, 162/291, 361, 362, 363, 367, 109, 113, 115, 116, 208

[56] References Cited

U.S. PATENT DOCUMENTS

| | | | |
|---|---|---|---|
| 1,699,760 | 1/1929 | Sherman . | |
| 2,771,363 | 11/1956 | Fish | 162/117 |
| 2,862,251 | 12/1958 | Kalwaites | 19/161 |
| 2,902,395 | 9/1959 | Hirschy et al. | 161/57 |
| 3,025,585 | 3/1962 | Griswold | 28/1 |
| 3,034,180 | 5/1962 | Greiner et al. | 19/155 |
| 3,072,511 | 1/1963 | Harwood | 154/46 |
| 3,081,500 | 3/1963 | Griswold et al. | 19/161 |
| 3,081,512 | 3/1963 | Griswold | 28/72 |
| 3,081,514 | 5/1963 | Griswold | 28/78 |
| 3,081,515 | 5/1963 | Griswold et al. | 28/78 |
| 3,491,802 | 1/1970 | Mortensen et al. | 139/420 |
| 3,681,182 | 8/1972 | Kalwaites | 161/109 |
| 3,681,183 | 8/1972 | Kalwaites | 161/109 |
| 3,881,987 | 5/1975 | Benz | 162/116 |
| 4,191,609 | 3/1980 | Trokhan | 162/113 |
| 4,528,239 | 7/1985 | Trokhan | 428/247 |
| 4,529,480 | 7/1985 | Trokhan | 162/109 |
| 4,840,829 | 6/1989 | Suzuki et al. | 428/131 |
| 4,921,034 | 5/1990 | Burgess et al. | 162/109 |
| 5,098,519 | 3/1992 | Ramasubramanian | 162/109 |
| 5,126,015 | 6/1992 | Pounder | 162/206 |

FOREIGN PATENT DOCUMENTS

0490655A1 6/1992 European Pat. Off. .

OTHER PUBLICATIONS

Veratec Sales Presentation by Zoltan Mate, May 8, 1991—Wet Laid Hydroentangled Formation.

*Primary Examiner*—Donald E. Czaja
*Assistant Examiner*—Dean T. Nguyen
*Attorney, Agent, or Firm*—Larry L. Huston; E. Kelly Linman; Jacobus C. Rasser

[57] ABSTRACT

An apparatus and process for making the fibrous structure, having three four, and more regions. The process is similar to known papermaking techniques, but comprises the additional steps of applying a differential pressure to selected regions of the fibrous structure which are not coincident with the regions of the fibrous structure defined by the apparatus in prior steps of the papermaking process. The selective application of noncoincident differential pressure to selected regions of the fibrous structure may result in densification or dedensification of such regions.

6 Claims, 16 Drawing Sheets

DEVIATION ABOVE REFERENCE PLANE 0.025
0.250
0.350
0.200
0.300
0.400

ALL DIMENSIONS IN MILLIMETERS

THICKNESS IN MILLIMETERS 0.200 0.250 0.300 0.350 0.400 0.475

ALL DIMENSIONS IN MILLIMETERS

APPARATUS FOR FORMING A CELLULOSIC FIBROUS STRUCTURES HAVING AT LEAST THREE REGIONS DISTINGUISHED BY INTENSIVE PROPERTIES

This is a continuation of application Ser. No. 08/382,551, filed on Feb. 2, 1995, now abandoned, which is a continuation of application Ser. No. 08/071,834, filed on Jul. 10, 1997, now U.S. Pat. No. 5,443,691, which is a continuation of application Ser. No. 07/724,551, filed on Jun. 28, 1991, now U.S. Pat. No. 5,277,761.

FIELD OF THE INVENTION

The present invention relates to cellulosic fibrous structures having at least three regions distinguished from one another by basis weight, density and/or projected average pore size.

BACKGROUND OF THE INVENTION

Cellulosic fibrous structures, such as paper, are well known in the art. Frequently, it is desirable to have regions of different basis weights within the same cellulosic fibrous product. The two regions, as exhibited by paper in the prior art, serve different purposes. The regions of higher basis weight impart tensile strength to the fibrous structure. The regions of lower basis weight may be utilized for economizing raw materials, particularly the fibers used in the papermaking process and to impart absorbency to the fibrous structure. In a degenerate case, the low basis weight regions may represent apertures or holes in the fibrous structure. However, it is not necessary that the low basis weight regions be apertured.

The properties of absorbency and strength, and further the property of softness, become important when the fibrous structure is used for its intended purpose. Particularly, the fibrous structure described herein may be used for facial tissues, toilet tissue, and a paper towel, each of which is in frequent use today. If these products are to perform their intended tasks and find wide acceptance, the products must exhibit and maximize the physical properties discussed above. Tensile strength is the ability of a fibrous structure to retain its physical integrity during use. Absorbency is the property of the fibrous structure which allows it to retain contacted fluids. Both the absolute quantity of fluid and the rate at which the fibrous structure will absorb such fluid must be considered when evaluating one of the aforementioned consumer products. Further, such paper products have been used in disposable absorbent articles such as sanitary napkins and diapers.

Several attempts have been made in the art to provide efficient and economical means to manufacture paper having two different basis weights. One of the very early attempts is illustrated in U.S. Pat. No. 795,719 issued Jul. 25,, 1905 to Motz, which patent discloses a Fourdrinier wire having a number of upstanding protuberances and which is passed between two rollers. One advance over Motz is illustrated by U.S. Pat. No. 3,025,585 issued Mar. 20, 1962 to Griswold which discloses a belt having tapered projections 61 that rearrange fibers deposited thereon.

Various shapes of protuberances have been used in conjunction with papermaking machines, yielding differing basis weight regions, such as low basis weight regions of varying shapes. For example, U.S. Pat. No. 3,034,180 issued May 15, 1962 to Greiner et al. discloses protuberances which are pyramid shaped, cross-shaped, etc. Even the knuckles of a Fourdrinier wire may be utilized as upstanding protuberances, as illustrated in U.S. Pat. No. 3,159,530 issued Dec. 1, 1964 to Heller et al.

Instead of apertures, U.S. Pat. No. 3,549,742 issued Dec. 22, 1970 to Benz shows a foraminous drainage member having flow control members which project above the surface of the drainage member a distance less than the thickness of the fibrous structure formed thereon and the fibrous structure may be later densified in a hard nip. Another teaching that fiber concentrations in areas of a fibrous structure may be dispersed so that, dependent upon the length of the fibers, island areas of extremely thin cross-section may be produced is shown by U.S. Pat. No. 3,322,617 issued May 30, 1967 to Osborne.

Finally, several attempts to provide an improved foraminous member for making such cellulosic fibrous structures are known, one of the most significant being illustrated in U.S. Pat. No. 4,514,345 issued Apr. 30, 1985 to Johnson et al. Johnson et al. teaches hexagonal elements attached to the framework in a batch liquid coating process.

However, one problem present with the paper made according to each of these references is that the tensile strength of such paper is limited by the strength of the high basis weight regions of such paper. If the high basis weight regions are strengthened by adding more fibers, a noneconomical use of raw materials results.

Another problem with the paper made according to the foregoing references is that the absorbency is limited by the low basis weight regions of the paper. Because the low basis weight regions are taught to be of constant density and thickness, such paper is limited in how absorbent it will be for the user.

One explanation for the limited properties of the paper produced according to the prior art may be that such paper is produced entirely in registration with the protuberances, as taught in the aforementioned references. That is, after the fibrous slurry which forms the paper having plural basis weights is deposited on the Fourdrinier wire, all subsequent operations, such as drying, etc., are carried out in registration with the high and low basis weight regions as originally formed.

One attempt to vary the density of paper made according to the prior art is by joining two plies of the paper together and knob-to-knob embossing the resulting laminate as taught in U.S. Pat. No. 3,414,459 issued Dec. 3, 1968 to Wells. However, while this operation increases the density of the embossed areas, it has no effect on the basis weight and adds a converting step to the papermaking process.

Accordingly, it is an object of this invention to overcome such problems of the prior art and particularly to overcome such problems as they relate to a single lamina of paper. Specifically, it is an object of this invention to provide a paper which increases the tensile strength through providing a stronger high basis weight region, without substantially increasing the number of fibers utilized to make the high basis weight region. Also, it is an object of this invention to provide low basis weight regions having enhanced absorbency by providing plural densities and/or plural projected average pore sizes in such low basis weight regions. Further, it is an object of this invention to provide plural densities and/or plural projected average pore sizes without a dedicated converting operation, such as embossing. It is also an object of this invention to accomplish the foregoing without radical departure from known papermaking machinery and techniques.

The foregoing may be accomplished by carrying out steps in the process of forming the claimed cellulosic fibrous structure which comprise operations which are selectively applied to regions of the fibrous structure, which selected regions are not coincident the regions distinguished and defined by mutually basis weights or densities. Particularly, the step of applying a noncoincident differential pressure to the fibrous structure is useful. Such noncoincidence may occur through differences in size, pattern registration, or combinations thereof, between the originally formed plural basis weight and density regions and the regions to which a differential pressure is selectively applied.

BRIEF SUMMARY OF THE INVENTION

The product according to the present invention comprises a single lamina macroscopically planar cellulosic fibrous structure. The cellulosic fibrous structure has at least three identifiable regions which may be distinguished from one another by intensive properties appearing in a nonrandom, repeating pattern. Particularly, intensive properties which may be used to identify and distinguish different regions of the fibrous structure are basis weight, thickness, density and/or projected average pore size.

In a preferred embodiment, the cellulosic fibrous structure may comprise an essentially continuous network of fibers. The essentially continuous network has a first basis weight and a first density. Dispersed throughout the essentially continuous network is a nonrandom, regular repeating pattern of discrete regions having a basis weight less than the basis weight of the essentially continuous network or a density less than the density of the essentially continuous network. Within the essentially continuous network are identifiable regions having a greater thickness or density, preferably at least about 25 percent greater, than the first density of the balance of the essentially continuous network. Regions may also be identified as having a smaller projected average pore size, preferably at lest about 25 percent smaller size.

In a second embodiment, the fibrous structure may comprise four regions. Two of the regions are adjacent and have generally mutually equivalent relatively high basis weights. The first relatively high basis weight region has a first thickness or density, and the second relatively high basis weight region has a second thickness or density which is less than the first thickness or density of the adjacent first relatively high basis weight region. The other two adjacent regions have generally mutually equivalent relatively low basis weights. The first relatively low basis weight region has a first thickness or density, and the second relatively low basis weight regions has a second thickness or density which is less than the first thickness or density of the adjacent first relatively low basis weight region. Preferably, the thickness or density difference between the high and low basis weight regions is at least about 25 percent.

Alternatively, the two adjacent high basis weight regions may be distinguished by a relative difference in projected average pore size. Likewise the adjacent low basis weight regions may be distinguished by a relative difference in projected average pore size.

Preferably, the second relatively high basis weight region, having low density, corresponds to the coincidence of differential pressure with portions of the parent regions, which was a predetermined portion of the first relatively high basis weight region. Likewise, preferably, the second relatively low basis weight region, having low density, corresponds to the coincidence of differential pressure with portions of the parent region which was a predetermined portion of the first relatively low basis weight region.

The cellulosic fibrous structures described above may be made according to the process of providing a fibrous slurry, a liquid pervious, fiber retentive forming element having two distinct topographical regions on one face and which distinct regions orthogonally vary from the opposed face of the forming element, a means to deposit the fibrous slurry onto the forming element, a means to apply a differential pressure to selected portions of the fibrous slurry, and a means to dry the fibrous slurry. The fibrous slurry is deposited onto the forming element and a differential pressure is applied to selected regions of the fibrous slurry, which selected regions are not coincident the two distinct topographical regions of the forming element. The fibrous slurry is dried to form the aforementioned two dimensional fibrous structure. Preferably, the thickness or density differences occurring within the high and low basis weight regions are at least about 25 percent.

Alternatively, the two adjacent high basis weight regions may be distinguished by a relative difference in projected average pore size. Likewise the adjacent low basis weight may be distinguished by a relative difference in projected average pore size.

The selectively applied differential pressure may be applied by mechanical compression so that a nonrandom, repeating patterned mechanical interference with the fibers results. The fibrous slurry may be transferred to a secondary belt having upstanding protuberances not coincident with the topographical regions of the forming element. The protuberances of the secondary belt are then compressed against a relatively rigid surface, such as a Yankee drying drum.

Alternatively, the selectively applied nonrandom, repeating patterned differential pressure may be applied by drawing a vacuum across the fibrous slurry. This step may be preferentially accomplished by transferring the fibrous slurry from the forming element to a secondary belt. The secondary belt has vacuum pervious regions 63 not coincident with the two topographical regions of the forming element. The vacuum is then drawn through the pervious regions of the secondary belt to dedensify and increase the projected average pore size of the selected regions of the fibrous structure in a nonrandom, repeating pattern.

BRIEF DESCRIPTION OF THE DRAWINGS

While the Specification concludes with claims particularly pointing out and distinctly claiming the present invention, it is believed the invention is better understood from the following description taken in conjunction with the associated drawings, in which like elements are designated by the same reference numeral, analogous elements are designated with a prime symbol and:

DETAILED DESCRIPTION OF THE INVENTION

The Product

Figure 1:
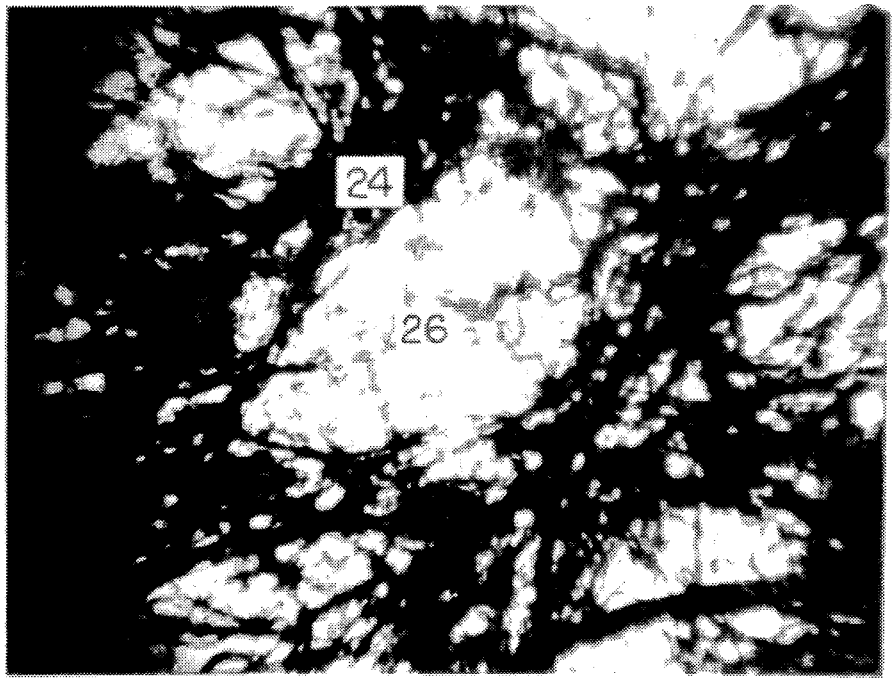
FIG. 1 PRIOR ART
FIG. 1 is a plan view of a two basis weight cellulosic fibrous structure according to the prior art.

A cellulosic fibrous structure 20' is fibrous, macroscopically two-dimensional and planar, although not necessarily flat, as illustrated in FIG. 1. A cellulosic fibrous structure 20' does have some thickness in the third dimension. However, the thickness in the third dimension is very small compared to the actual first two dimensions or to the capability to manufacture a fibrous structure 20' having relatively very large measurements in the first two dimensions. Within the fibrous structure 20' are various regions 24' and 26' distinguished by a property such a basis weight, density, projected average pore size or thickness.

The two-dimensional cellulosic structure 20' are composed of fibers which are approximated by linear elements. The fibers are components of the two-dimensional fibrous structure 20', which components have one very large dimension (along the longitudinal axis of the fiber) compared to the other two relatively very small dimensions (mutually perpendicular, and both radial and perpendicular to the longitudinal axis of the fiber), so that linearity is approximated. While, microscopic examination of the fibers may reveal two other dimensions which are small, compared to the principal dimension of the fibers, such other two small dimensions need not be substantially equivalent or constant throughout the axial length of the fiber. It is only important that the fiber be able to bend about its axis and be able to bond to other fibers.

The fibers may be synthetic, such as polyolefin or polyester; are preferably cellulosic, such as cotton linters, rayon or bagasse; and more preferably are wood pulp, such as softwoods (gymnosperms or coinferous) or hardwoods (angiosperms or deciduous) or are layers of the foregoing. As used herein, a fibrous structure 20 or 20' is considered "cellulosic" if the fibrous structure 20 or 20' comprises at least about 50 weight percent or at least about 50 volume percent cellulosic fibers, including but not limited to those fibers listed above. A cellulosic mixture of wood pulp fibers comprising softwood fibers having a length of about 2.0 to about 4.5 millimeters and a diameter of about 25 to about 50 micrometers, and hardwood fibers having a length of less than about 1 millimeter and a diameter of about 12 to about 25 micrometers has been found to work well for the fibrous structures 20 described herein.

It is not necessary, or even likely, that the various regions 24' and 26° of the fibrous structure 20' having the same or a uniform distribution of hardwood and softwood fibers. Instead, it is likely that a lower basis weight region 26' will have a higher percentage of softwood fibers than a higher basis weight region 24'. Furthermore, the hardwood and softwood fibers may be layered throughout the thickness of the cellulosic fibrous structure 20'.

If wood pulp fibers are selected for the fibrous structure 20, the fibers may be produced by any pulping process including chemical processes, such as sulfite, sulphate and soda processes; and mechanical processes such as stone groundwood. Alternatively, the fibers may be produced by combinations of chemical and mechanical processes or may be recycled. The type, combination, and processing of the fibers used in the present invention are not critical to the present invention.

The fibrous structure 20 according to the present invention comprises a single lamina even if multiple layers of fibers are present. However, it is to be recognized that two single laminae may be joined in face-to-face relation to form a unitary laminate. A structure according to the present invention is considered to be "single lamina" if it is taken off the forming element, discussed below, as a single sheet having a thickness, when dried, which does not change unless fibers are added to or removed from the sheet. The cellulosic fibrous structure 20 may be later embossed, or remain nonembossed, as desired.

With reference of FIG. 1, it is understood from the prior art that the two regions fibrous structure 20' according to the prior art may be defined by discriminating regions 24' and 26' having differing intensive properties. For example, as illustrated in Table I, the basis weight of the fibrous structure 20' provides an intensive property which distinguishes the two regions 24' and 26' of the fibrous structure 20' from each other. These two regions 24' and 26' may be the parent regions, from which the other regions are formed in the fibrous structures 20 of FIGS. 3A and 3B.

TABLE I

| Region | Relative Basis Weight | Relative Density |
|---|---|---|
| 24' | High | Medium |
| 26' | Low | Medium |

It is to be understood that rather than using basis weight as the intensive property discriminating the two regions 24' and 26', density or projected average pore size could be used as an intensive property to distinguish the two regions 24' and 26'.

Figure 2:
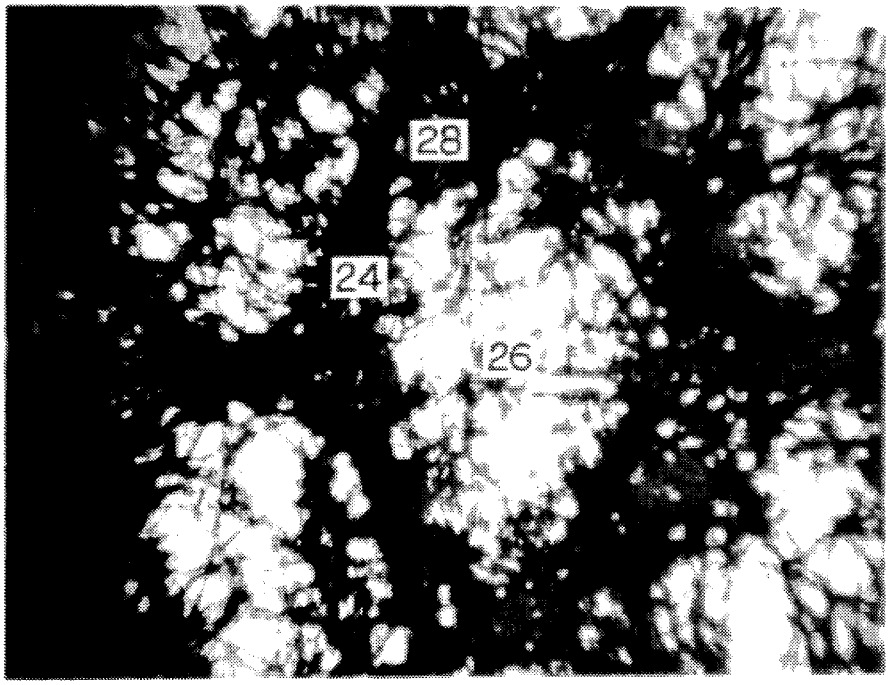
FIG. 2 is a plan view of a three intensive region cellulosic fibrous structure according to the present invention and having an essentially continuous high basis weight network with discrete densified regions wherein and discrete low basis weight regions.

As shown in FIG. 2, the cellulosic fibrous structure 20 according to the present invention has at least three distinct regions 24, 26, and 28. The regions 24, 26, and 28 are distinguished by intensive properties of the structure 20. As used herein a property is considered "intensive" if it does not have a value dependent upon the aggregation of values in the fibrous structure 20. Examples of intensive properties include the basis weight, density, projected average pore size, temperature, specific heat, compressive the tensile moduli, etc., of the fibrous structure 20. As used herein properties which depend upon the aggregation of various values of subsystems or components of the fibrous structure 20 are considered "extensive." Examples of extensive properties include the weight, mass, volume, heat capacity and moles of the fibrous structure 20.

Intensive and extensive properties may be further classified as intensive or extensive within the two dimensions corresponding to the plane of the cellulosic fibrous structure 20 or extensive in three dimensions, depending upon whether or not fibers may be aggregated in two or in three dimensions without affecting the property. For example, if fibers are aggregated to the cellulosic fibrous structure 20 in its plane, making the cellulosic fibrous structure 20 cover a greater surface area, the thickness of the cellulosic fibrous structure 20 remains unaffected. But, if the fibers are aggregated by superimposition with either exposed face of the cellulosic fibrous structure 20, the thickness is affected. Thus, thickness is a two dimensional intensive property. However, adding fibers to the cellulosic fibrous structure 20 in either manner specified above does not affect the tensile strength per unit of cross sectional area of the cellulosic fibrous structure 20. Therefore, tensile strength per unit of cross sectional area is a three dimensional intensive property.

The fibrous structure 20 according to the present invention has regions 24, 26, and 28 having at lest two distinct basis weights which are divided between at least two identifiable segments, hereinafter referred to as "regions," of the fibrous structure 20. As used herein, the "basis weight" is the weight, measured in grams force, of a unit area of the fibrous structure 20, which unit area is taken in the plane of the fibrous structure 20. The size of the unit area from which the basis weight is measured is dependent upon the relative and absolute sizes of the regions 24, 26, and 28 having differing basis weights.

It will be recognized by one skilled in the art that within a given region 24, 26, or 28, ordinary and expected basis weight fluctuations and variations may occur, when such given region is considered to have one basis weight. For example, if on a microscopic level, the basis weight of an interstice is measured, an apparent basis weight of zero will result when, in fact, unless an aperture in the fibrous structure 20 is being measured, the basis weight of such region 24, 26 or 28 is greater than zero. Such fluctuations and variations are a normal and expected result of the manufacturing process.

Two regions 24, 26 or 28 of the fibrous structure 20 are considered to have different basis weight if the basis weight of the regions 24, 26 and 28 varies by at least about 25 percent of the higher basis weight value. In a fibrous structure 20 according to the present invention, the basis weight differences between the regions 24, 26 and 28 occur in a nonrandom repeating pattern, corresponding to a pattern in the liquid draining, fiber retentive forming element described more fully below. Otherwise, if the variation of the region 24, 26 or 28 of the fibrous structure 20 under consideration is less than about 25 percent, the region 24, 26, or 28 is considered to comprise one region 24, 26, or 28 of a singular and particular basis weight having a variation of +/−12.5 percent about a median value.

It is not necessary that exact boundaries divide adjacent regions 24, 26, or 28 of different basis weights, or that a sharp demarkation between adjacent regions 24, 26, or 28 of different basis weights be apparent at all. It is only important that the distribution of fibers per unit area be different in different positions of the fibrous structure 20 and that such different distribution occurs in a nonrandom, repeating pattern.

It will be apparent to one skilled in the art that there may be small transition regions having a basis weight intermediate the basis weights of the adjacent regions 24, 26, or 28, which transition regions by themselves may not be significant enough in area to be considered as comprising a basis weight distinct from the basis weights of either adjacent region 24, 26, or 28. Such transition regions are within the normal manufacturing variations known and inherent in producing a fibrous structure 20 according to the present invention.

The intensively distinguished regions 24, 26, and 28 of the fibrous structure 20, such as regions 24, 26, and 28 having different basis weights, are disposed throughout the fibrous structure 20 in a nonrandom, repeating pattern. The patterned regions 26 and 28 may be discrete, so that adjacent regions 26 or 28 having the same basis weight are not contiguous. Alternatively, a region 24 having one basis weight throughout the entirety of the fibrous structure 20 may be continuous, so that such region 24 extends substantially throughout the fibrous structure 20 in one or both of its principal dimensions. By being "nonrandom," the intensively defined regions 24, 26, and 28 are considered to be predictable, and may occur as a result of known and predetermined features of the apparatus used in the manufacturing process. By "repeating" the pattern is formed more than once in the fibrous structure 20.

Of course, it is to be recognized that if the fibrous structure 20 is very large as manufactured, and the regions 24, 26, and 28 are very small compared to the size of the fibrous structure 20 during manufacture, e.g. varying by several orders of magnitude, absolute predictability of the exact dispersion and patterns among the various regions 24, 26, and 28 may be very difficult or even impossible. However, it is only important that such intensively defined regions 24, 26, and 28 be dispersed in a pattern substantially as desired to yield the performance properties which render the fibrous structure 20 suitable for its intended purpose.

The size of the pattern of the fibrous structure 20 may vary from about 1.5 to about 388 discrete regions 26 per square centimeter (from 10 to 2,500 discrete regions 26 per square inch), preferably from about 11.6 to about 155 discrete regions 26 per square centimeter (from 75 to 1,000 discrete regions 26 per square inch), and more preferably from about 23.3 to about 116 discrete regions 26 per square centimeter (from 150 to 750 discrete regions 26 per square inch). It will be apparent to one skilled in the art that as the pattern becomes finer (having more discrete regions per square centimeter) a larger percentage of the smaller sized hardwood fibers should be utilized, and the percentage of the larger sized softwood fibers should be correspondingly reduced.

If too many large sized fibers are utilized, the fibers may not be able to conform to the topography of the apparatus, described below, which produces the fibrous structure 20. If the fibers do not properly conform, fibers may bridge various topographical regions of the apparatus, leading to a random patterned fibrous structure 20. A mixture comprising about 0 to about 40 percent northern softwood kraft fibers and about 100 to about 60 percent hardwood chemi-thermomechanical pulp fibers has been found to work well for a fibrous structure having about 31.0 to about 46.5 discrete regions per square centimeter (200 to 300 discrete regions 26 per square inch).

Referring to FIGS. 1 and 2, the regions 24, 24', 26 and 26' of differing basis weights may be arranged within the fibrous structure 20 or 20' respectively, so that the region 24 of relatively higher (if the fibrous structure 20' comprises regions 24' and 26' of two distinct basis weights as in FIG. 1) or highest (if the fibrous structure 20 comprises regions 24, 26, and 28 of three or more distinct basis weights as in FIG. 2) basis weight is essentially continuous in at least one direction throughout the fibrous structure 20. Preferably, the continuous direction is parallel the direction of expected tensile loading of the finished product according to the present invention.

If the fibrous structure 20 illustrated in FIG. 2 is to be used as a consumer product, such as a paper towel or tissue, the high basis weight region 24 of the fibrous structure 20 is preferably essentially continuous in two orthogonal directions within the plane of the fibrous structure 20. It is not necessary that such orthogonal directions be parallel and perpendicular the edges of the finished product or be parallel and perpendicular the direction of manufacture of the product, but only the tensile strength be imparted to the product in two orthogonal directions, so that any applied tensile loading may be more readily accommodated without premature failure of the product due to such tensile loading.

If a region 24, 26 or 28 of a particular basis weight forms a repeating unbroken pattern throughout at least a portion of the fibrous structure 20, the fibrous structure 20 is considered to have an "essentially continuous network" of such region 24, 26 or 28 within such portion of the fibrous structure 20, recognizing the interruptions in the pattern are tolerable, albeit not preferred, so long as such interruptions do not substantially adversely affect the material properties of such portion of the fibrous structure 20. An example of an essentially continuous network is the high basis weight region 24 of the fibrous structure of FIG. 2. Other examples of two region fibrous structures 20' having essentially continuous networks are disclosed in U.S. Pat. No. 4,637,859 issued Jan. 20, 1987 to Trokhan and incorporated herein by reference for the purpose of showing a fibrous structure 20' having an essentially continuous network.

Furthermore, by providing an essentially continuous network high basis weight region 24, contact drying of the fibrous structure 20 may be enhanced. The enhanced contact drying, of course, requires that the essentially continuous high basis weight network 24 lie on and define one of the exposed faces of the fibrous structure 20.

Conversely, the low basis weight regions 26 may be discrete and dispersed throughout the high basis weight essentially continuous network 24. The low basis weight regions 26 may be thought of as islands which are surrounded by a circumjacent essentially continuous network high basis weight region 24. The discrete low basis weight regions 26 also form a nonrandom, repeating pattern. The discrete low basis weight regions 26 may be staggered in, or may be aligned in, either or both of the aforementioned two orthogonal directions. Preferably, the high basis weight essentially continuous network 24 forms a patterned network circumjacent the discrete low basis weight regions 26, although, as noted above, small transition regions may be accommodated.

Figure 6:
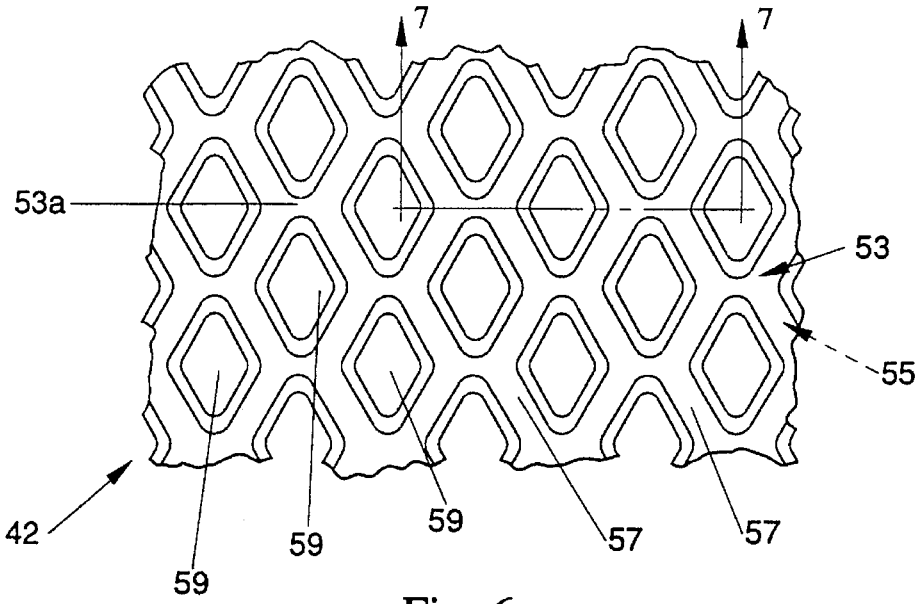
FIG. 6 is a fragmentary top plan view of the belt of the papermaking machine of FIG. 5.

In a degenerate case, the low basis weight regions 26 have an approximately or identically zero basis weight and represent apertures 26 within the essentially continuous network 24 of the fibrous structure 20. It is to be recognized that apertures 26 may have a near zero basis weight and still be considered apertures. As is known in the art, dependent upon the length of the fibers, the transverse dimension of the protuberances 59, discussed below (see FIGS. 6–7) and used to form the low basis weight regions 26, and the relative movement between the fibrous slurry at the time of deposition and the liquid pervious fiber retentive forming element onto which the fibrous slurry is deposited, some fibers may bridge the apertured low basis weight regions 26, preventing the basis weight therein from being absolute zero. Such small variations are known and commonly expected in the art and do not preclude the resulting cellulosic fibrous structure 20 from appearing to be the functioning as an apertured fibrous structure 20.

At the opposite end of the expected range of basis weights, the low basis weight regions 26 have a maximum basis weight about 75 percent of the basis weight of the high basis weight regions 24 and 28. If the basis weight of the low basis weight regions 26 is greater than about 75 percent of the basis weight of the high basis weight regions 24 and 28, the fibrous structure 20 is considered to lie within the expected variations of a single basis weight fibrous structure 20.

Referring to FIG. 2, the basis weight of the low basis weight regions 26 relative to the basis weight of the high basis weight regions 24 is dependent upon the particular performance characteristics desired in the finished product and the competing interests of using available materials in the most economical manner, consistent with obtaining the desired performance of the finished product. For example, while zero basis weight apertured regions 26 may represent the most economical use of raw materials, the consumer may react negatively to a consumer product, such as a paper towel or tissue, which is apertured. However, low basis weight regions 26 may be advantageously employed in such a product to provide areas of increased absorbency and retention of fluids which are deposited on or otherwise come in contact with the fibrous structure 20. Furthermore, the low basis weight regions provide areas of reduced section modulus so that the fibrous structure 20 is more compliant, and has a softer feel, to the user.

Preferably, the low basis weight regions 26 comprise about 20 percent to about 80 percent of the total surface area of the fibrous structure 20, and more preferably about 30 percent to about 50 percent of the total surface area of the fibrous structure 20. The aggregate of the two relatively high basis weight regions 24 and 28, described below, comprises the balance of the total surface area of the fibrous structure 20. As noted above, relative to the three region fibrous structure 20, if greater tensile strength is desired in the final product, the aggregate of the surface areas of the two regions 24 and 28 of higher basis weight should be relatively greater. Conversely, if increased absorbency and softness are desired, the percentage surface area of the low basis weight region 26 should be increased.

Each region 24, 26, and 28 of the fibrous structure 20 has an associated density. As used herein, "density" refers to the ratio of the basis weight to the thickness (taken normal to the plane of the fibrous structure 20) of a region 24, 26, or 28 of the fibrous structure 20 under consideration. The density is independent of, but related to, the basis weight of the different regions 24, 26, and 28 of the fibrous structure 20. Thus, two regions 24, 26, or 28 of differing basis weight may have the same density, or two regions 24, 26 or 28 of the same basis weight may have different densities.

If desired, density may be indirectly inferred through a related intensive property, average pore size. Generally, average pore size and density are generally inversely proportional. However, it is to be recognized that as the basis weight of a particular region 24, 26, or 28 increases beyond a certain point, the capillaries will be occluded by superimposed fibers, giving the appearance of a smaller capillary size.

In the direction normal to the plane of the fibrous structure 20, the regions 28 of higher density will typically have a smaller average pore size as projected in two dimensions than regions 24 and 26 of lower density, without regard to the basis weight of such regions 24, 26 or 28.

Referring to FIG. 2, the regions 24 and 26 defined and described by basis weight may be further intensively subdivided and described according to relative density differences which occur in such basis weight intensively defined regions 24 and 26. While differences in density among the low basis weight regions 26 may occur, in a fibrous structure 20 having three regions 24, 26, and 28 it is more important that differences in density occur in the high basis weight regions 24 and 28.

The reason underlying this importance is that as the density of the high basis weight regions 24 and 28 (or of the low basis weight regions 26 for that matter) increases, the degree of bonding of overlapping fibers also increases, providing for increased tensile strength of that region. Because the tensile strength of the fibrous structure 20 is controlled by the high basis weight essentially continuous network region 24, it is therefore more important that increased density (and hence tensile strength) be provided in such high basis weight essentially continuous network 24 than in the low basis weight regions 26, because increasing the density (and hence tensile strength) of the low basis weight regions 26 of the fibrous structure 20 will have little effect on the tensile strength of the fibrous structure 20. The regions 28 of increased density may be continuous, forming a secondary network within the high basis weight essentially continuous network 24 or, as illustrated in FIG. 2, may be discrete.

To provide efficacious results, based on measurable increases in tensile strength, the difference in density between the discrete densified regions 28 dispersed throughout the high basis weight essentially continuous network 24 and the balance of the high basis weight essentially continuous network 24 should be at least about 25 percent, and preferably at least about 35 percent. Thus, the difference between the densities of the high density region 28 and the low density regions 24 and 26 should be at least about 25 percent and preferably at least about 35 percent. If the difference in density is less than about 25 percent, such differences may fall within the normally expected manufacturing variations of fibrous products, and may not, in all likelihood, represent a significant, quantifiable difference in tensile strength.

As noted above, relative to the regions 24, 26 and 28 having different basis weights, it is not necessary that the regions 24, 26 and 28 of different densities have exact boundaries or that exact lines of demarkation between adjacent regions 24, 26, and 28 of different densities be apparent at all. It is only necessary that increased bonding occur, so that failure of the bonds of adjoining fibers is minimized in the presence of tensile loading. Also, as noted above relative to adjacent regions having different basis weights, small transition zones between the adjacent different density regions 24 and 28 may be present without adversely affecting the desired properties of the fibrous structure 20.

Thus, a fibrous structure 20 manufactured according to the present invention has three intensively distinct regions 24, 26 and 28. With reference to Table II, the first and third regions 24 and 28 are of a relatively high and substantially mutually equivalent basis weight. The second region Z6 is of relatively low basis weight. The density of the second region 24 is intermediate the densities of the first and third regions 26 and 28. The third region 28 is of higher density than is either the first region 24 or the second region 26. The first region 24 forms an essentially continuous network while the second and third regions 26 and 28 are discrete.

TABLE II

| Region | Relative Basis Weight | Relative Density |
|---|---|---|
| 24 | High | Medium |
| 26 | Low | Low |
| 28 | High | High |

Figure 3A:
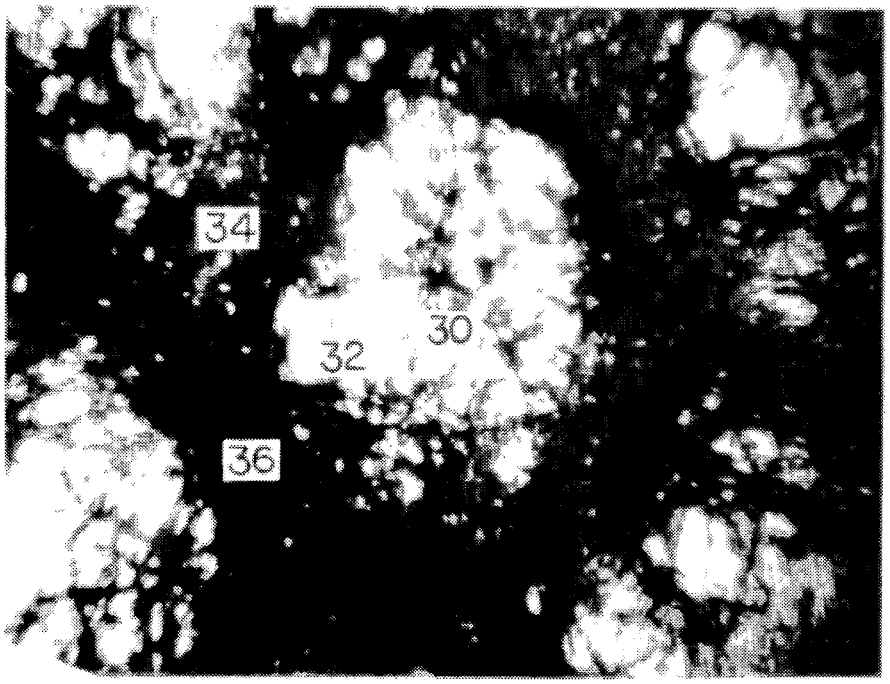
FIG. 3A is a plan view of a four intensive region creped fibrous structure according to the present invention, as viewed from the belt facing side of the fibrous structure and having two high basis weight regions and two low basis weight regions, each such basis weight defined region having a high density region and an adjacent low density region.
Figure 3B:
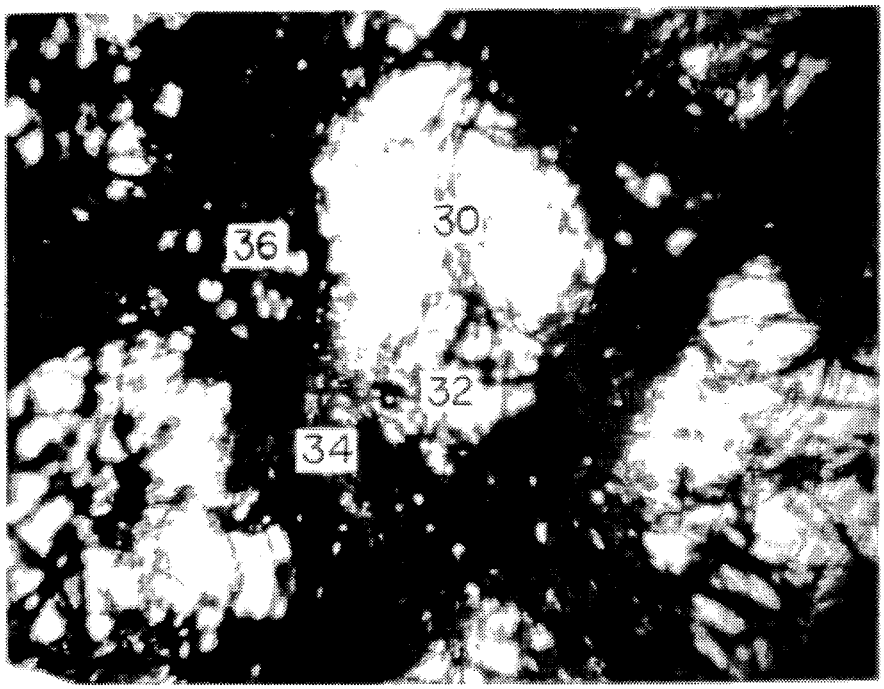
FIG. 3B is a plan view of opposite side of the fibrous structure illustrated in FIG. 3A.

Referring to FIGS. 3A and 3B, it is also feasible to provide a four region intensively distinguishable fibrous structure 20. Such a four region fibrous structure 20 may comprise two regions 30 and 32 of substantially mutually equivalent and relatively low basis weight and two regions 34 and 36 of substantially mutually equivalent relatively high basis weight. As illustrated in Table III, the two low basis weight intensively distinguishable regions 30 and 32 are further distinguished by having mutually different densities, these densities being the lesser two densities of such a fibrous structure 20. Likewise, the relatively high basis weight intensively distinguishable regions 34 and 36 are further distinguished by having mutually different densities, these densities being the greater two densities of such a fibrous structure 20.

TABLE III

| Region | Relative Basis Weight | Relative Density |
|---|---|---|
| 30 | Low | Low |
| 32 | Low | Very Low |

TABLE III-continued

| Region | Relative Basis Weight | Relative Density |
|---|---|---|
| 34 | High | High |
| 36 | High | Medium |

As illustrated in FIGS. 3A and 3B, the high basis weight, high density region 34 comprises an essentially continuous network which has the advantages of increased bonding of fibers (due to the relatively high density) and a high basis weight to provide a relatively large quantity of fibers for distribution of tensile loading. This region 34 will typically control the tensile strength of the fibrous structure 20.

The high basis weight, medium density regions 36 are typically discrete, although, if made large enough relative to the other three regions 30, 32, and 34, may also form an essentially continuous network, independent of whether any other region 30, 32 or 34 forms an essentially continuous network. Whether discrete or essentially continuous, the two high basis weight regions 34 and 36, both alone and when aggregated, are disposed in a nonrandom, repeating pattern. The two high basis weight regions 34 and 36 are typically adjacent, due to factors present in the manufacturing process described below.

The two low basis weight regions 30 and 32 are typically and preferably discrete. Preferably, the low basis weight, very low density regions 32 represent a larger percentage of the surface area of the fibrous structure 20 than the low basis weight, low density regions 30—so that the maximum savings of raw materials occurs. Whether discrete or essentially continuous, the two low basis weight regions 30 and 32, both alone and when aggregated, are disposed in a nonrandom, repeating pattern.

It is not necessary that the four intensively defined and distinguished regions 30, 32, 34, and 36 be of equivalent thicknesses, or that the four regions 30, 32, 34, and 36 be limited to two or to even three distance thicknesses. For example, typically the low basis weight, very low density regions 32 of the fibrous structure 20 will be of greater thickness that the low basis weight, low density regions 30 of the fibrous structure 20, due to factors present in the manufacturing process described below. Similarly, typically the high basis weight, medium density regions 36 of the fibrous structure 20 will be of greater thickness than the high basis weight, high density regions 34 of the fibrous structure 20, due to the same factors present in the manufacturing process.

Further, the high basis weight, high density regions 34 may be of lesser thickness than the low basis weight, very low density regions 32. However, the relative thickness between the high basis weight, medium density regions 36 and the low basis weight, very low density regions 32 and the relative thickness between the high basis weight, high density regions 34 and the low basis weight, low density regions 30 may vary so that it may be difficult to predict that one such region 36 or 32 will always have a greater or lesser thickness than the other such region 34 or 30.

For example and as stated in Table III, typically the high basis weight, high density region 34 will be of greater density than the high basis weight, medium density region 36. Further, the low density, low basis weight region 30 will be of greater density than the low basis weight, very low density region 32. However, the density of the high basis weight, medium density region 36 may be greater than, less than or equivalent the density of the low basis weight, low density region 30. The relative difference between the densities of these regions 36 and 30 is dependent upon the ratio of the basis weights to the thickness of such regions 36 and 30.

Such differences in thicknesses between the regions 30, 32, 34, and 36 may be accomplished, as described below, by either compressing fibers of the regions 30 and 34 having a lesser thickness or by expanding normal to the plane of the fibrous structure 20 the fibers of the regions 32 and 36 having greater thickness. However, it is to be recognized that typically the multiple of the thickness and density for either of the two low basis weight regions 30 and 32 will be mutually equivalent. Likewise, the product obtained by multiplying the thickness and density for either of the high basis weight regions 34 and 36 will be mutually equivalent. For regions 30, 32, 34 and 36 having equal basis weights, thickness and density are inversely proportional.

Preferably, the aggregate of the projected surface areas of the two low basis weight regions 30 and 32 comprises about 20 percent to about 80 percent of the total area of the fibrous structure 20, and preferably about 30 to about 50 percent of the projected total surface area of the fibrous structure 20. The aggregate of the projected surface areas of the two relatively high basis weight regions 34 and 36 comprises the balance of the projected surface area of the fibrous structure 20. As noted above, relative to the three region fibrous structure 20 of FIG. 2, if greater tensile strength is desired in the final product, the aggregate of the two regions 34 and 36 of higher basis weight should be relatively greater. Conversely, if increased absorbency or softness is desired, the aggregate of the two low basis weight regions 30 and 32 should be increased.

Several variations to the fibrous structures 20 according to the present invention are feasible. For example, it is not necessary that the fibrous structures 20 be limited to two basis weights, as disclosed above, or to four densities as disclosed above. It is possible that fibrous structures 20 according to the present invention may have three or more regions defined by basis weights and also more than four regions defined by densities. Therefore, the combinations and permutations of regions based upon the product of regions having differing basis weights and differing densities is almost limitless, but is certainly at least three and four, as noted above, and may be greater as shown below.

Other ways exist to increase the tensile strength of the fibrous structure 20 according to the present invention, and to enhance the drying of a fibrous slurry to the aforementioned fibrous structure 20 as discussed below. For example, to increase the tensile strength of the fibrous structure 20, a strength additive, such as latex binder or an adhesive, may be added to the high basis weight essentially continuous network 24 at discrete sites, rather than or in addition to having regions 28 of increased density distributed throughout the high basis weight essentially continuous network 24.

Also, tensile strength may be enhanced by having greater orientation and parallelism of fibers at discrete sites throughout the high basis weight essentially continuous network 24. Further, instead of increasing the density, the basis weight may be increased throughout various sites within the high basis weight essentially continuous network 24 to provide more fibers, and hence more fiber bonds, to carry and distribute tensile loads. Finally, increased bonding of fibers may occur at discrete sites within the high basis weight essentially continuous network 24. All such modifications to the high basis weight essentially continuous network 24 provide for enhanced distribution of any tensile loading which is applied to the fibrous structure 20.

ANALYTICAL PROCEDURES

Basis Weight

The basis weight of a fibrous structure 20 according to the present invention may be qualitatively measured by optically viewing (under magnification if desired) the fibrous structure 20 in a direction generally normal to the plane of the fibrous structure 20. If differences in the amount of fibers, particularly the amount observed from any line normal to the plane, occur in a nonrandom, regular repeating pattern, it can generally be determined that basis weight differences occur in a like fashion.

Particularly the judgment as to the amount of fibers stacked on top of other fibers is relevant in determining the basis weight of any particular region 24, 26 or 28 or differences in basis weights between ay two regions 24, 26 or 28. Generally, differences in basis weights among the various regions 24, 26 or 28 will be indicated by inversely proportional differences in the amount of light transmitted through such regions 24, 26 or 28.

If a more accurate determination of the basis weight of one region 24, 26 or 28 relative to a different region 24, 26, or 28, is desired, such magnitude of relative distinctions may be quantified using multiple exposure soft X-rays to make a radiographic image of the sample, and subsequent image analysis. Using the soft X-ray and image analysis techniques, a set of standards having known basis weights are compared to a sample of the fibrous structure 20. The analysis uses three masks: one to show the discrete low basis weight regions 26, one to show the continuous network of high basis weight regions 24 and 28, and one to show the transition regions 33. Reference will be made to FIGS. 9–14 in the following description. However, it is to be understood while FIGS. 9–14 relate to a specific example, the following description of basis weight determination is not so limited.

In the comparison, the standards and the sample are simultaneously soft X-rayed in order to ascertain and calibrate the gray level image of the sample. The soft X-ray is taken of the sample and the intensity of the image is recorded on the film in proportion to the amount of mass, representative of the fibers in the fibrous structure 20, in the path of the X-rays.

If desired, the soft X-ray may be carried out using a Hewlett Packard Faxitron X-ray unit supplied by the Hewlett Packard Company, of Palo Alto, Calif. X-ray film sold as NDT 35 by the E.I. DuPont Nemours & Co. of Wilmington, Del. and JOBO film processor rotary tube units may be used to advantageously develop the image of the sample described hereinbelow.

Due to expected and ordinary variations between different X-ray units, the operator must set the optimum exposure conditions for each X-ray unit. As used herein, the Faxitron unit has an X-ray source size of about 0.5 millimeters, a 0.64 millimeters thick Beryllium window and a three milliamp continuous current. The film to source distance is about 61 centimeters and the voltage about 8 kVp. The only variable parameter is the exposure time, which is adjusted so that the digitized image would yield a maximum contrast when histogrammed as described below.

The sample is die cut to dimensions of about 2.5 by about 7.5 centimeters (1 by 3 inches). If desired, the sample may be marked with indicia to allow precise determination of the locations of regions 24, 26 and 28 having distinguishable basis weights. Suitable indicia may be incorporated into the sample by die cutting three holes out of the sample with a small punch. For the embodiments described herein, a punch about 1.0 millimeters (0.039 inches) in diameter has been found to work well. The holes may be colinear or arranged in a triangular pattern.

These indicia may be utilized, as describe below, to match regions 24, 26, and 28 of a particular basis weight with regions 24, 26 and 28 distinguished by other intensive properties, such as thickness and/or density. After the indicia are placed on the sample, it is weighted on a analytical balance, accurate to four significant figures.

The Dupont NDT 35 film is placed onto the Faxitron X-ray unit, emulsion side facing upwards, and the cut sample is places onto the film. About five 15 millimeter×15 millimeter calibration standards of known basis weights (which approximate and bond the basis weight of the various regions 24, 26, and 28 of the sample) and known areas are also placed onto the X-ray unit at the same time, so that an accurate basis weight to gray level calibration can be obtained each time the image of the sample is exposed and developed. Helium is introduced into the Faxitron for about 5 minutes at a regulator setting of about one psi, so that the air is purged and, consequently, absorption of X-rays by the air is minimized. The exposure time of the unit is set for about 2 minutes.

Following the helium purging of the sample chamber, the sample is exposed to the soft X-rays. When exposure is completed, the film is transferred to a safe box for developing under the standard conditions recommended by E.I. DuPont Nemours & Co., to form a completed radiographic image.

The preceding steps are repeated for exposure time periods of about 2.2, 2.5, 3.0, 3.5 and 4.0 minutes. The film image made by each exposure time is then digitized by using a high resolution radioscope Line Scanner, made by Vision Ten of Torrence, Calif., in the 8 bit mode. Images may be digitized at a spatial resolution of 1024×1024 discrete points representing 8.9×8.9 centimeters of the radiograph. Suitable software for this purpose includes Radiographic Imaging Transmission and Archive (RITA) made by Vision Ten. The images are then histogrammed to record the frequency of occurrence of each gray level value. The standard deviation is recorded for each exposure time.

The exposure time yielding the maximum standard deviation is used throughout of following steps. If the exposure times do not yield a maximum standard deviation, the range of exposure times should be expanded beyond that illustrated above. The standard deviations associated with the images of expanded exposure times should be recalculated. These steps are repeated until a clearly maximum standard deviation becomes apparent. The maximum standard deviation is utilized to maximize the contrast obtained by the scatter in the data. For the samples illustrated in FIGS. 8–14, an exposure time of about 2.5 to about 3.0 minutes was judged optimum.

The optimum radiograph is re-digitized in the 12 bit mode, using the high resolution Line Scanner to display the image on a 1024×1024 monitor at a one to one aspect ratio and the Radiographic Imaging Transission and Archive software by Vision Ten to store, measure and display the images. The scanner lens is set to a field of view of about 8.9 centimeters per 1024 pixels. The film is now scanned in the 12 bit mode, averaging both linear and high to low lookup tables to covert the image back to the eight bit mode.

This image is displayed on the 1024×1024 line monitor. The gray level values are examined to determine any gradients across the exposed areas of the radiograph not blocked by the sample or the calibration standards. The radiograph is judged to be acceptable if any one of the following three criteria is met:

- the film background contains no gradients in gray level values from side to side;
- the film background contains no gradients in gray level values from top to bottom; or
- a gradient is present in only one direction, i.e. a difference in gray values from one side to the other side at the top of the radiograph is matched by the same difference in gradient at the bottom of the radiograph.

One possible shortcut method to determine whether or not the third condition may be met is to examine the gray level values of the pixels located at the four corners of the radiograph, which covers are adjacent the sample image.

The remaining steps may be performed on a Gould Model IP9545 Image Processor, made by Gould, Inc., of Fremont, Calif. and hosted by a Digitized Equipment Corporation VAX 8350 computer, using Library of Image Processor Software (LIPS) software.

A portion of the film background representative of the criteria set forth above is selected by utilizing an algorithm to select areas of the sample which are of interest. These areas are enlarged to a size of 1024×1024 pixels to simulate the film background. A gaussian filter (matrix size 29×29) is applied to smooth the resulting image. This image, defined as not containing either the sample or standards, is then saved as the film background.

This film background is digitally subtracted from the subimage containing the sample image on the film background to yield a new image. The algorithm for the digital subtraction dictates that gray level values between 0 and 128 should be set to a value of zero, and gray level values between 129 and 255 should be remapped from 1 to 127 (using the formula x-128). Remapping corrects for negative results that occur in the subtracted image. The values for the maximum, minimum, standard deviation, median, mean, and pixel area of each image area are recorded.

The new image, containing only the sample and the standards, is saved for future reference. The algorithm is then used to selectively set individually defined image areas for each of the image areas containing the sample standards. For each standard, the gray level histogram is measured. These individually defined areas are then histogrammed.

The histogram data from the preceding step is then utilized to develop a regression equation describing the mass to gray level relationship and which computes the coefficients for the mass per gray value equation. The independent variable is the mean gray level. The dependent variable is the mass per pixel in each calibration standard. Since a gray level value of zero is defined to have zero mass, the regression equation is forced to have a y intercept of zero. The equation may utilize any common spreadsheet program and be run on a common desktop personal computer.

Figure 9:
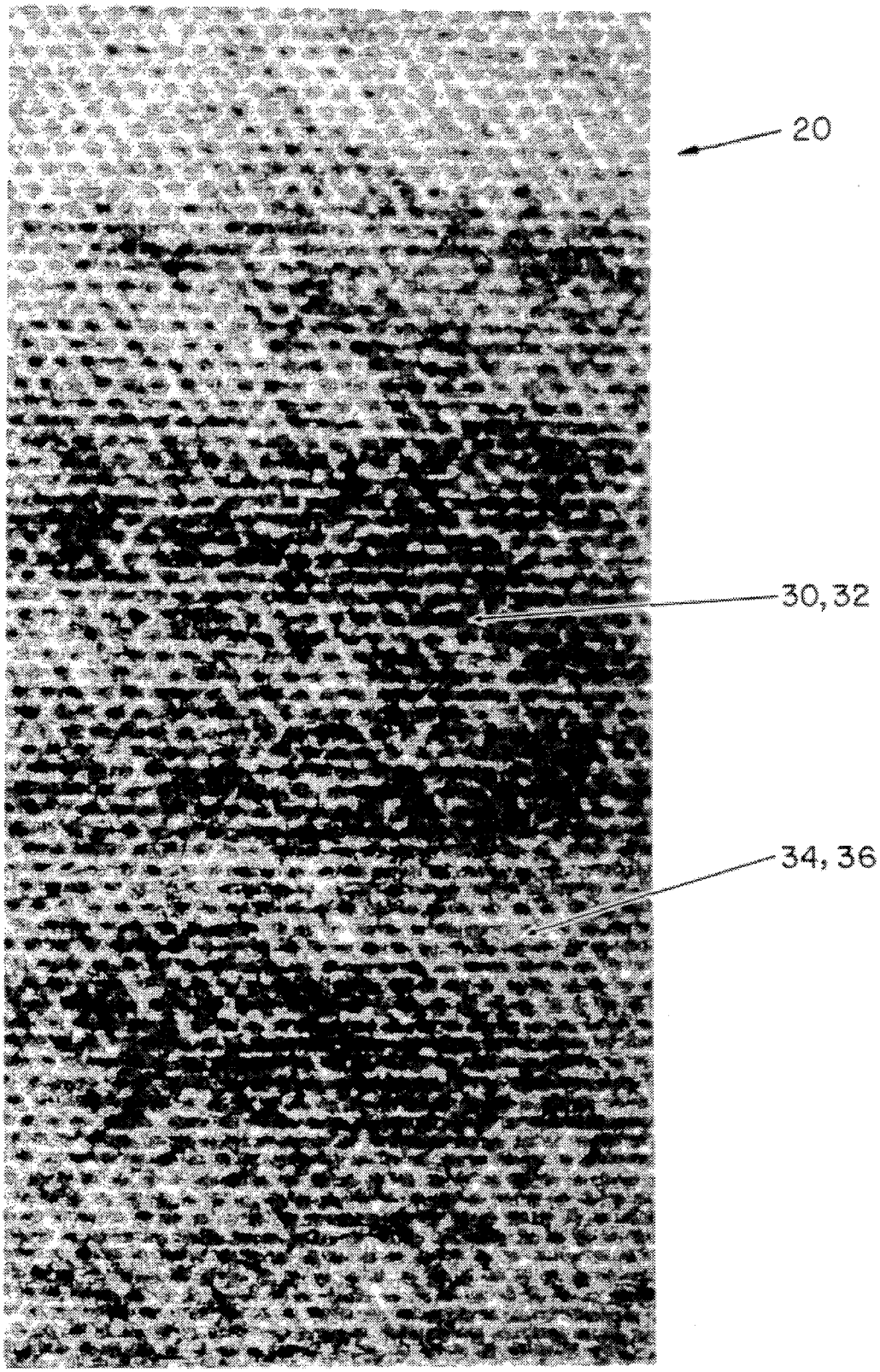
FIG. 9 is a soft X-ray image plan view of a creped fibrous structure according to the present invention and particularly the fibrous structure illustrated in FIGS. 3A and 3B.

The algorithm is then used to define the area of the image containing only the sample. This image, shown in FIG. 9, is saved for further reference, and is also classified as to the number of occurrences of each gray level. The regression equation is then used in conjunction with the classified image data to determine the total calculated mass. The form of the regression equation is:

$$Y=A\times X\times N$$

wherein Y equals the mass for each gray level bin; A equals the coefficient from the regression analysis; X equals the gray level (range 0–255); and N equals the number of pixels in each bin (determined from classified image). The summation of all of the Y values yields the total calculated mass. For precision, this value is then compared to the actual sample mass, determined by weighing.

The calibrated image of FIG. 9 is displayed onto the monitor and the algorithm is utilized to analyze a 256×256 pixel area of the image. This area is then magnified equally in each direction six times. All of the following images are formed from this resultant image.

Figure 14:
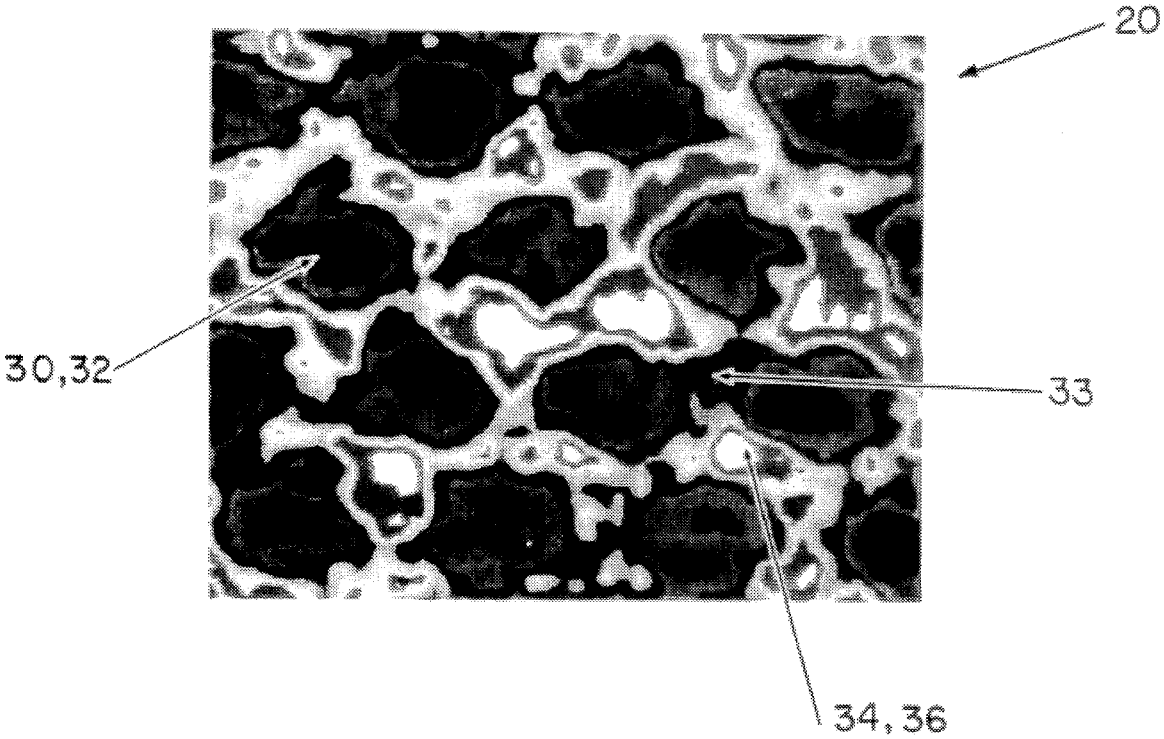
FIG. 14 is a soft X-ray image plan view of the fibrous structure of FIG. 9, showing the low basis weight regions, the transition regions, and the high basis weight regions.

If desired, an area of the resultant image, shown in FIG. 14, containing about ten sites of the nonrandom, repeating pattern of the various regions 30, 32, 34 and 36 may be selected for segmentation of the various regions 30, 32, 34 or 36. It will be apparent that if the differences in basis weights between regions 30, 32, 34 and 36 are relatively small, more than ten sites may be necessary to assure statistical significance in the results. The resultant image shown in FIG. 14 is saved for future reference. Using a digitizing tablet equipped with a light pen, an interactive graphics masking routine may be used to define transition regions between the high basis weight regions 34 and 36 and the low basis weight regions 30 and 32. The operator should subjectively and manually circumscribe the discrete regions 30 and 32 with the light pen at the midpoint between the discrete regions 30 and 32 and the continuous regions 34 and 36 and fill in these regions 30 and 32. The operator should ensure a closed loop is formed about each circumscribed discrete region 30 or 32. This step creates a border around and between any discrete regions 30 and 32 which can be differentiated according to the gray level intensity variations.

The graphics mask generated in the preceding step is then copied through a bit plane to set all masked values (such as in region 30 or 32) to a value of zero, and all unmasked values (such as in regions 34 and 36) to a value of 128. This mask is saved for future reference. This mask, covering the discrete regions 30 and 32, is then outwardly dilated for pixels around the circumference of each masked region 30 or 32.

The aforementioned magnified image of FIG. 14 is then copied through the dilated mask. This produces an image shown in FIG. 12, having only the continuous network of eroded high basis weight regions 34 and 36. The image of FIG. 12 is saved for future reference and classified as to the number of occurrences of each gray level value.

The original mask is copied through a lookup table that reramps gray values from 0–128 to 128–0. This reramping has the effect of inverting the mask. This mask is then inwardly dilated four pixels around the border drawn by the operator. This has the effect of eroding the discrete regions 30 and 32.

The magnified image of FIG. 14 is copied through the second dilated mask, to yield the eroded low basis weight regions 30 and 32. The resulting image, shown in FIG. 10, is then saved for future reference and classified as to the number of occurrences of each gray level.

Figure 10:
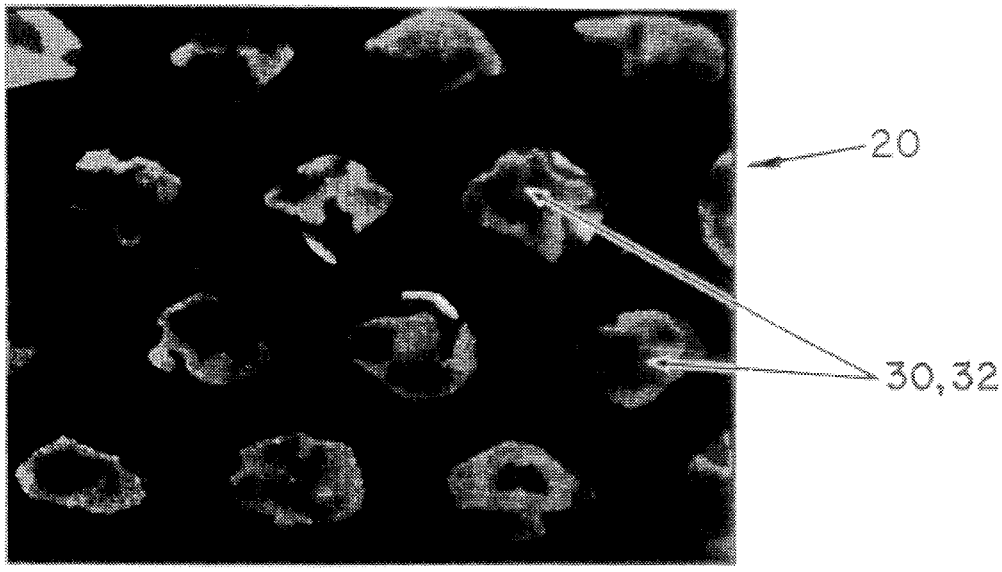
FIG. 10 is a soft X-ray image plan view of the fibrous structure of FIG. 9, showing only the transition regions.
Figure 12:
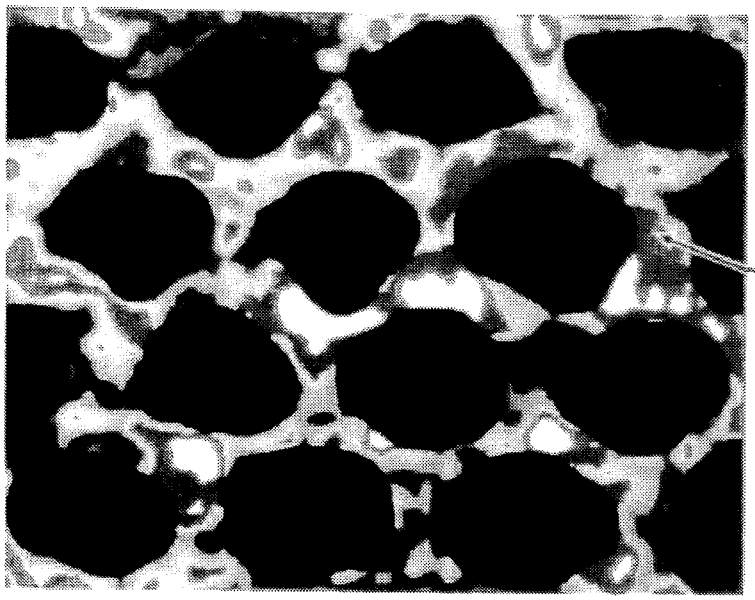
FIG. 12 is a soft X-ray image plan view of the fibrous structure of FIG. 9, showing only the high basis weight regions.

In order to obtain the pixel values of the transition regions, the two four pixel wide regions dilated into both the high and low basis weight regions 30, 32, 34 and 36, one should combine the two eroded images made from the dilated masks an shown in FIGS. 10 and 12. This is accomplished by first loading one of the eroded images into one memory channel and the other eroded image into another memory channel.

The image of FIG. 10 is copied onto the image of FIG. 12, using the image of FIG. 10 as a mask. Because the second image of FIG. 12 was used as the mask channel, only the non-zero pixels will be copied onto the image of FIG. 12. This procedure produces an image containing the eroded high basis weight regions 34 and 36, the eroded low basis weight regions 30 and 32, but not the nine pixel wide transition regions 33 (four pixels from each dilation and one from the operator's circumscription of the regions 30 and 32). This image, shown in FIG. 13, without the transition regions is saved for future reference.

Figure 13:
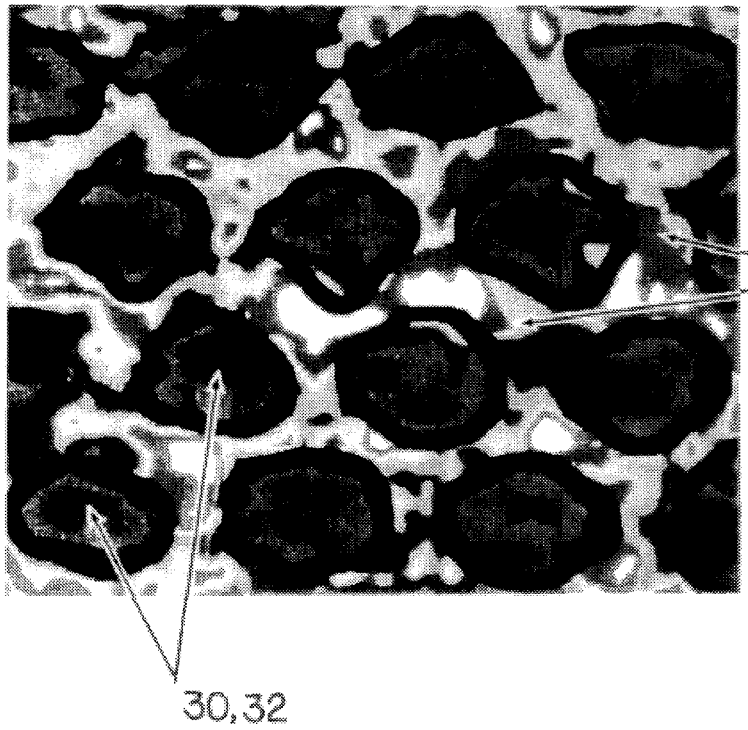
FIG. 13 is a soft X-ray image plan view of the fibrous structure of FIG. 9, showing only the low basis weight regions, and the high basis regions, but not the transition regions.

Since the pixel values for the transition regions 33 in the transition region image of FIG. 13 all have a value of zero and one knows the image cannot contain a gray level value greater than 127, (from the subtraction algorithm), all zero values are set to a value of 255. All of the non-zero values from the eroded high and low basis weight regions 30, 32, 34 and 36 in the image of FIG. 13 are set to a value of zero. This produces an image which is saved for future reference.

To obtain the gray level values of the transition regions 33, the image of FIG. 14 is copied through the image of FIG. 13 to obtain only the nine pixel wide transition regions 33. This image shown in FIG. 11, is saved for future reference and also classified as to the number of occurrences per gray level.

Figure 11:
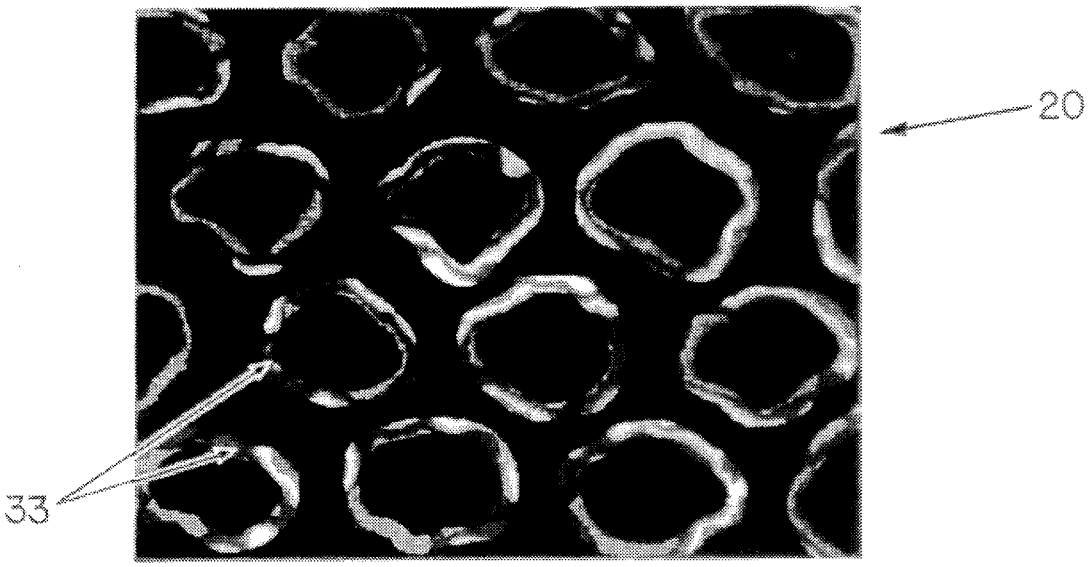
FIG. 11 is a soft X-ray image plan view of the fibrous structure of FIG. 9, showing only the transition regions.

So that relative differences in basis weight for the low basis weight regions 30 and 32, high basis weight regions 34 and 36, and transition region 33 can be measured, the data from each of the classified images above and shown in FIGS. 10, 12, and 11 respectively are then employed with the regression equation derived from the sample standards. The total mass of any region 24, 26, 28 or 33 is determined by the summation of mass per grey level bin from the image histogram. The basis weight is calculated by dividing the mass values by the pixel area, considering any magnification.

The classified image data (frequency) for each region of the images shown in FIGS. 10–12 and 14 may be displayed as a histogram and plotted against the mass (gray level), with the ordinate as the frequency distribution. If the resulting curve is monomodal the selection of areas and the subjective drawing of the mask were likely accurately performed. The images may also be pseudo-colored so that each color corresponds to a narrow range of basis weights with the following table as the possible template for color mapping.

The image resulting from this proceeding step is then pseudo-colored, based upon the range of gray levels. The list of gray levels shown in Table IVA has been found suitable for uncreped samples of cellulosic fibrous structures 20:

TABLE IVA

| Gray Level Range | Color |
|---|---|
| 0 | Black |
| 1–5 | Dark blue |
| 6–10 | Light blue |
| 11–15 | Green |
| 16–20 | Yellow |
| 21–25 | Red |
| 26+ | White |

Creped samples typically have a higher basis weight than otherwise similar uncreped samples. The list of grey levels shown in Table IVB was found suitable for use with creped samples of cellulosic fibrous structures 20:

TABLE IVB

| Gray Level Range | Color |
|---|---|
| 0 | Black |
| 1–7 | Dark blue |
| 8–14 | Light blue |
| 15–21 | Green |
| 22–28 | Yellow |
| 29–36 | Red |
| 36+ | White |

The resulting image may be dumped to a pringer/plotter. If desired, a cursor line may be drawn across any of the aforementioned images, and a profile of the gray levels developed. If the profile provides a qualitatively repeating pattern, this is further indication that a nonrandom, repeating pattern of basis weights is present in the sample of the fibrous structure 20.

If desired, basis weight differences may be determined by using an electron beam source, in place of the aforementioned soft X-ray. If it is desired to use an electron beam for the basis weight imagining and determination, a suitable procedure is set forth in European Patent Application 0,393,305 A2 published Oct. 24, 1990 in the names of Luner et al., which application is incorporated herein by reference for the purpose of showing a suitable method of determining difference in basis weights of various regions 30, 32, 34 and 36 of the fibrous structure 20.

Density

The relative densities of given regions 30, 32, 34 or 36 of the fibrous structure 20 may be qualitatively differentiated as follows. Samples of the fibrous structure, at least about 2.5 centimeters by 5.1 centimeters (1 inch by 2 inches) in area are provided. It is to be recognized that if that, dependent upon the relative sizes of the regions 30, 32, 34 or 36, a larger sample may be required or alternatively a smaller sample may be suitable. A water based magic marker, such as a red Berol marker ™8800 is provided and the samples are uniformly stained by hand using the water based marker. The samples are then dried at room temperature and 50% relative humidity for at least about 1 hour.

The samples are pressed between two pre-cleaned microslides. Using a stereomicroscope, such as a Nikon model SMZ-2T, such as maybe obtained from the Frank E. Feyer Company of Carpenterville, Ill., the samples are placed so that any diviations from the general plane of the sample are downwardly oriented, towards the base of the microscope. The magnification is adjusted to approximately 18×, dependent upon the relative size of the regions to be observed. Light is principally supplied from the bottom of the sample and adjusted to maximize the apparent contrast between the low density regions 24 and 26 and the high density regions 28.

If a repeating nonrandom pattern of high density regions 28 appear, such regions will likely be relatively light red in color. Conversely, relatively low density regions 24 and 26 will appear to be dark brown in color. Such color differences are caused by the differential density. If desired, color photographs may be taken of the samples to later confirm the findings made by the stereoscopic microscopic examination.

Alternatively, density differences may be qualitatively or quantitatively determined by ascertaining the differences in basis weights of various regions 30, 32, 34 or 36 of the fibrous structure 20 and combining such basis weight differences with the thicknesses of the regions 30, 32, 34 or 36 of the fibrous structure 20 to determine density differences. Thickness may be determined as set forth below.

Thickness

While several methods to determine thickness are presented below, the preferred method is that presented in the text accompanying FIGS. 15A–18and represents the method from which all of the thickness values discussed herein were taken. However, any method accurate and precise method of determining the thickness of the fibrous structure 20 may be utilized.

Figure 15A:
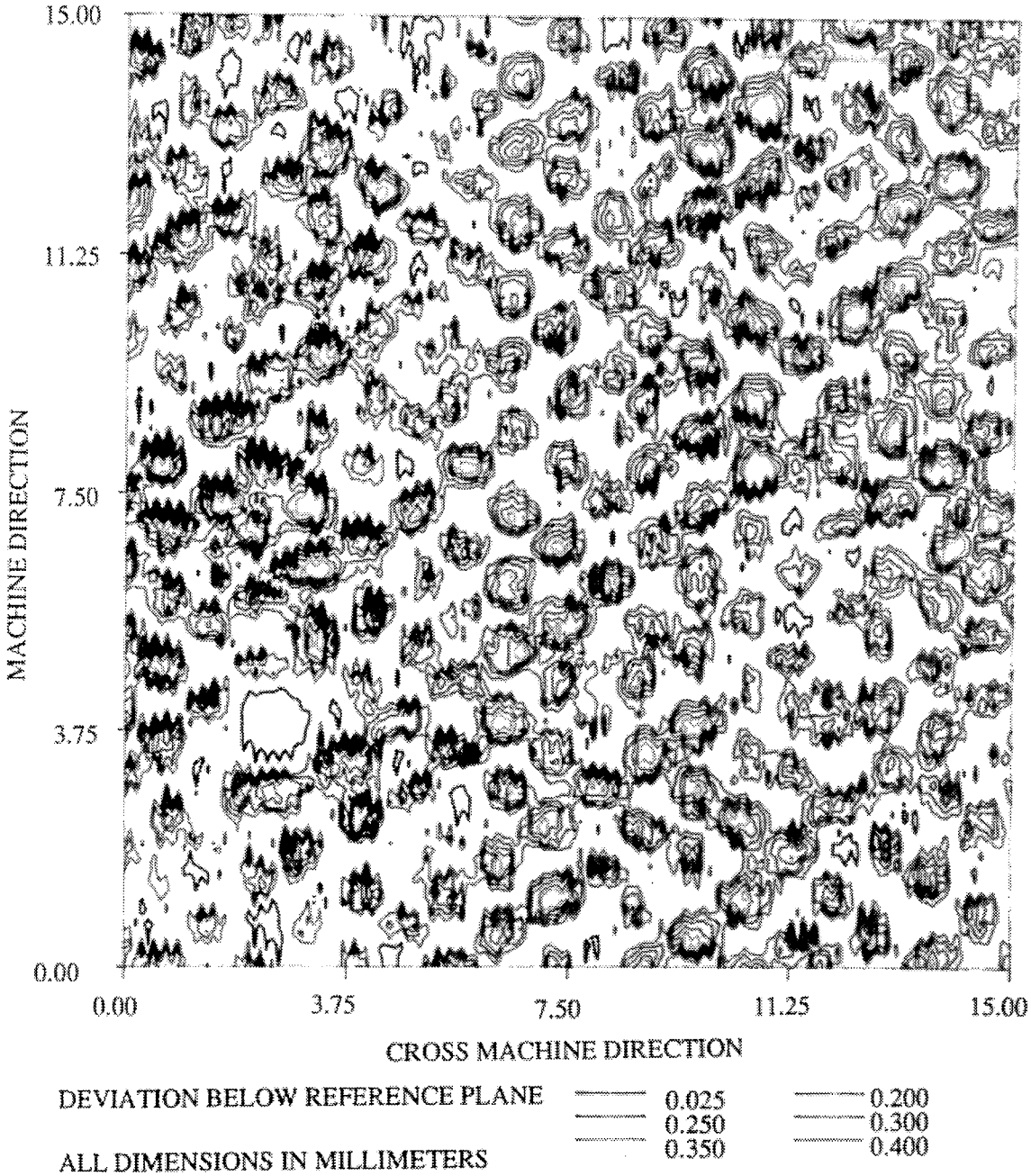
FIG. 15A is an isogram of the opposite side of the fibrous structure according to the present invention, particularly the face which contacts the forming belt.
Figure 15B:
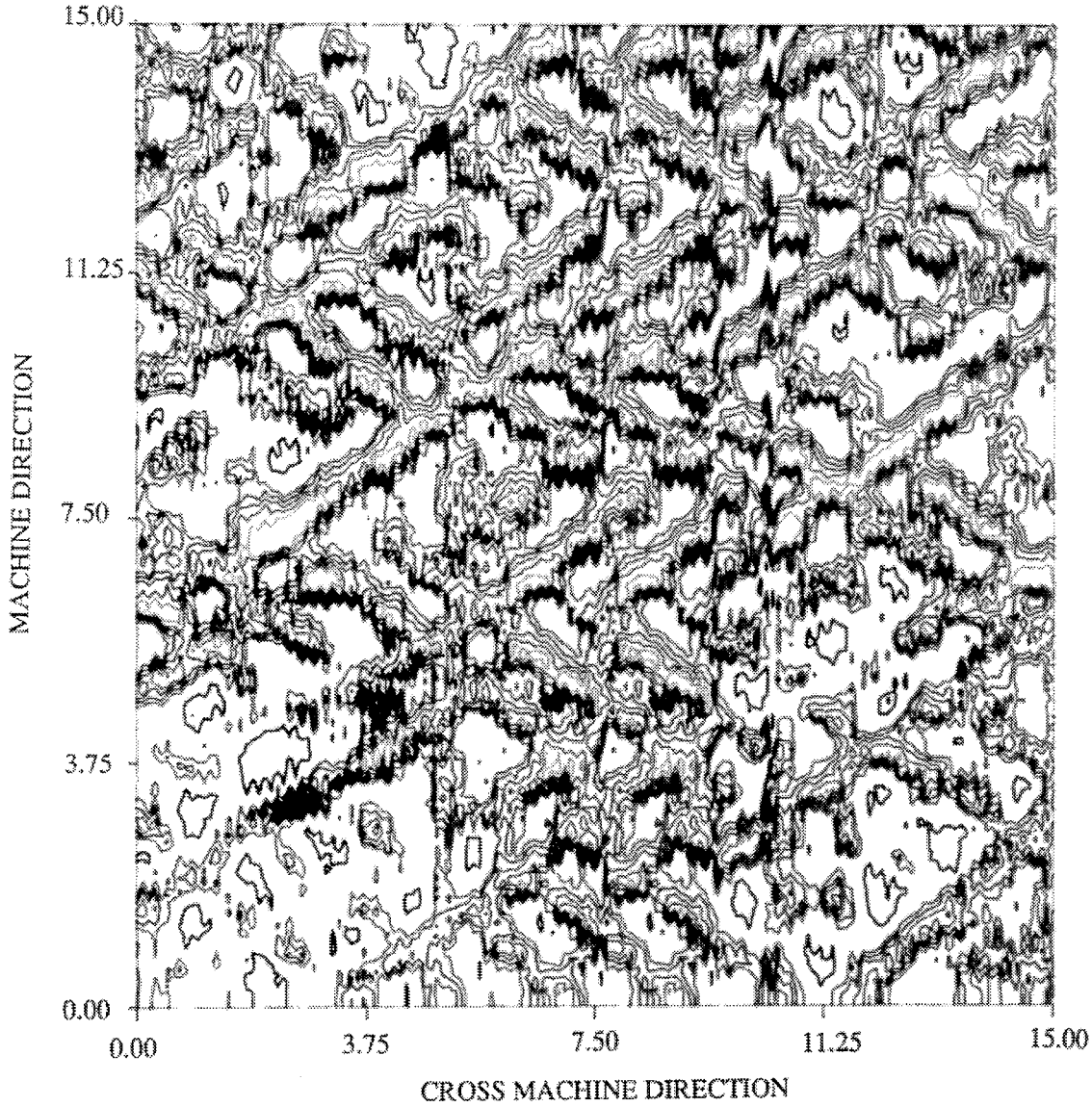
FIG. 15B is an isogram of the opposite side of the fibrous structure illustrated in FIG. 15A.

A preferred method to determine the thickness of different regions 30, 32, 34 and 36 of the fibrous structure 20 is to topographically measure the elevation of each exposed face of the fibrous structure 20. This produces a series of isobaths on one face of the fibrous structure 20 and a series of isobases on the other face, as illustrated in FIGS. 15A and 15B. The data of these two figures may be superimposed, as described below to determine the thickness of the fibrous structure 20.

If desired, the sample may be marked with three or more indicia, as described above with respect ato the basis weight measurements. Suitable indicia are punched holes. For example, one such hole appears at coordinate location 2.50, 3.75 of FIGS. 15A, 15B and 17.

The punched holes allow for matching the thicknesses of various regions 30, 32, 34 and 36 with the basis weights of the same regions 24, 26 and 28, providing the same sample is used for both measurements and moreover to match opposite sides of the same sample for and during the following thickness measurements. Since the soft x-ray image analysis and topographical scanning are nondestructive tests, this is entirely feasible.

The topographical measurements may be made using a Federal Products Series 432 profilometer having a Model EAS-2351 amplifier, a Model EPT-01049 breakaway probe, stylus and a flat horizontal table, sold by the Federal Esterline Company of Providence, R.I. For the measurements described herein, the stylus had a 2.54 micron (0.0001 inch) radius and a vertical force loading of 200 milligrams. The table is planar to 0.2 microns.

A sample of the fibrous structure 20 to be measured is placed on the horizontal table and any noticeable wrinkles are smoothed. The sample may be held in place with magnetic strips. The sample is scanned in a square wave pattern at a rate of 60.0 millimeters per minute (2.362 inches per minute) or 1.0 millimeter per second. The data digitization rate converts 20 data points per millimeter, so that a reading is taken every 50 microns.

The sample is traced 30 millimeters in one direction, then manually indexed while in motion 0.1 millimeter (0.004 inches) in a traverse direction. This process is repeated until the desired area of the sample has been scanned. Preferably the trace starts at one of the punched holes, so registering the isograms of opposite faces, as described below, is more easily accomplished.

The digitized data are fed into and analyzed by any Fourier transform analysis package. An analysis package such as Proc Specta made by SAS of Princeton, N.J. has been found to work well. The Fourier analysis of each face of the fibrous structure 20, as illustrated in FIGS. 16A and 16B, displays the pitch of the nonrandom repeating pattern apparent on that face.

Figure 16A:
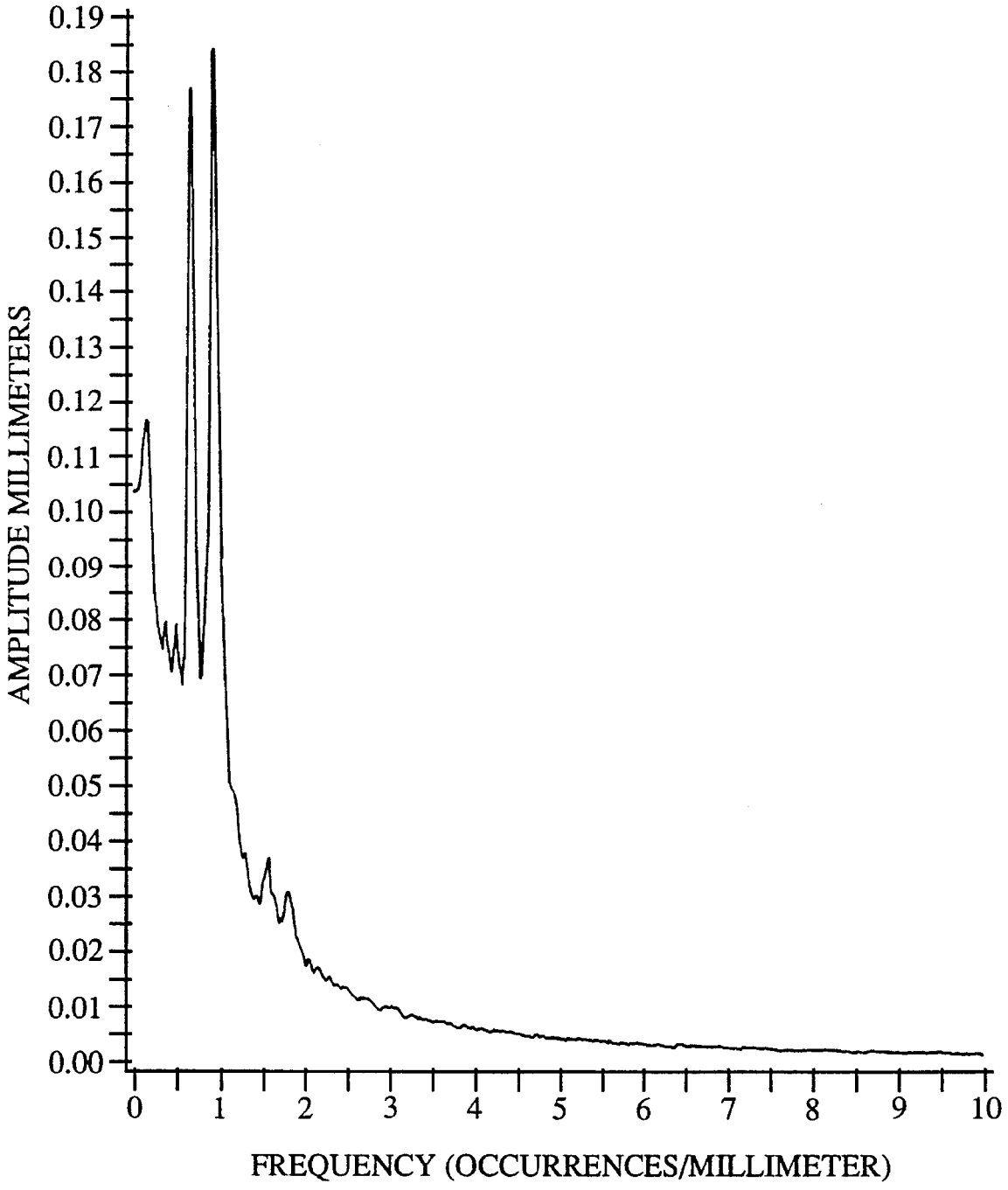
FIG. 16A is a Fourier transform of the isogram of FIG. 15A.
Figure 16B:
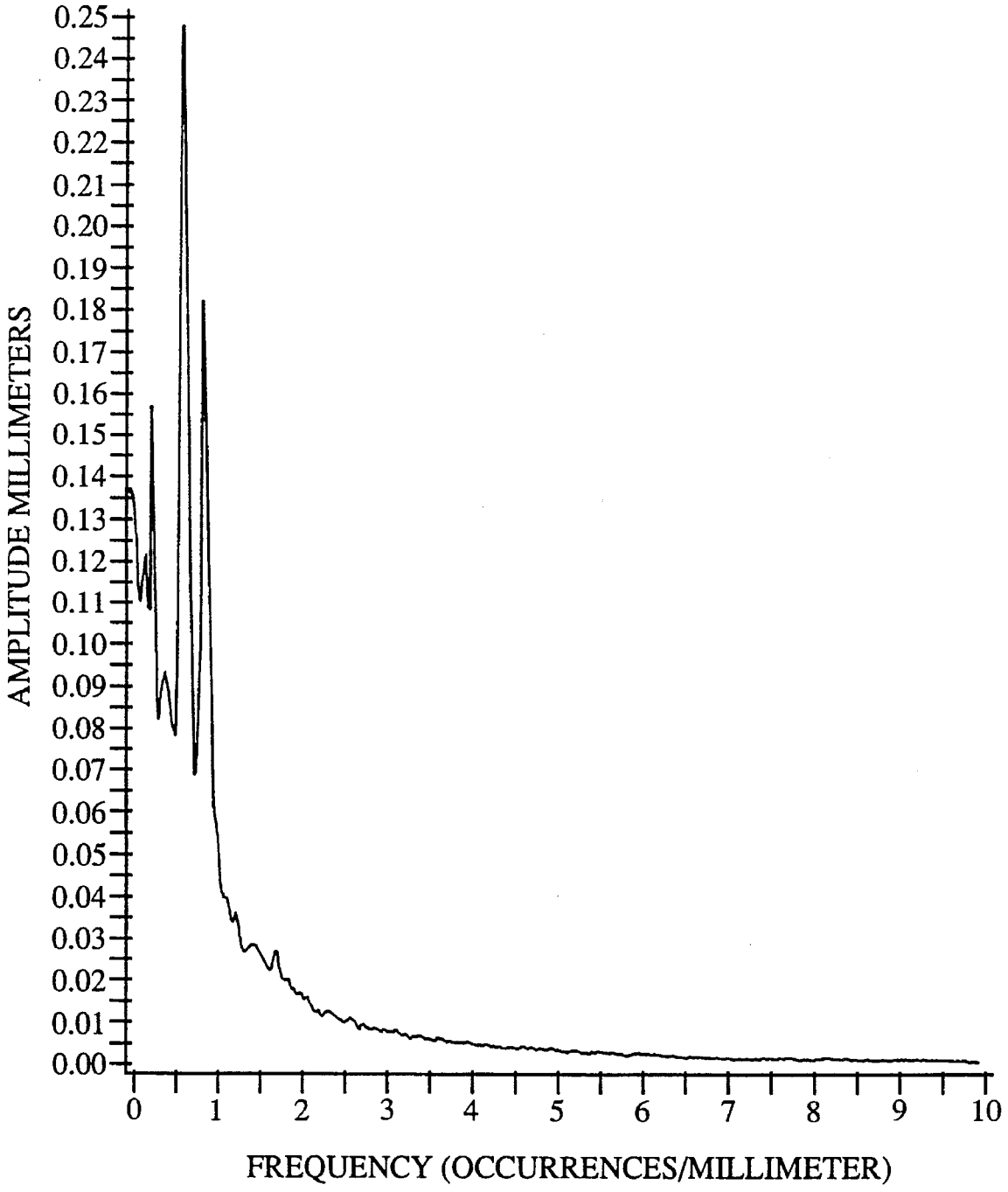
FIG. 16B is a Fourier transform of the isogram of FIG. 15B.
Figure 18:
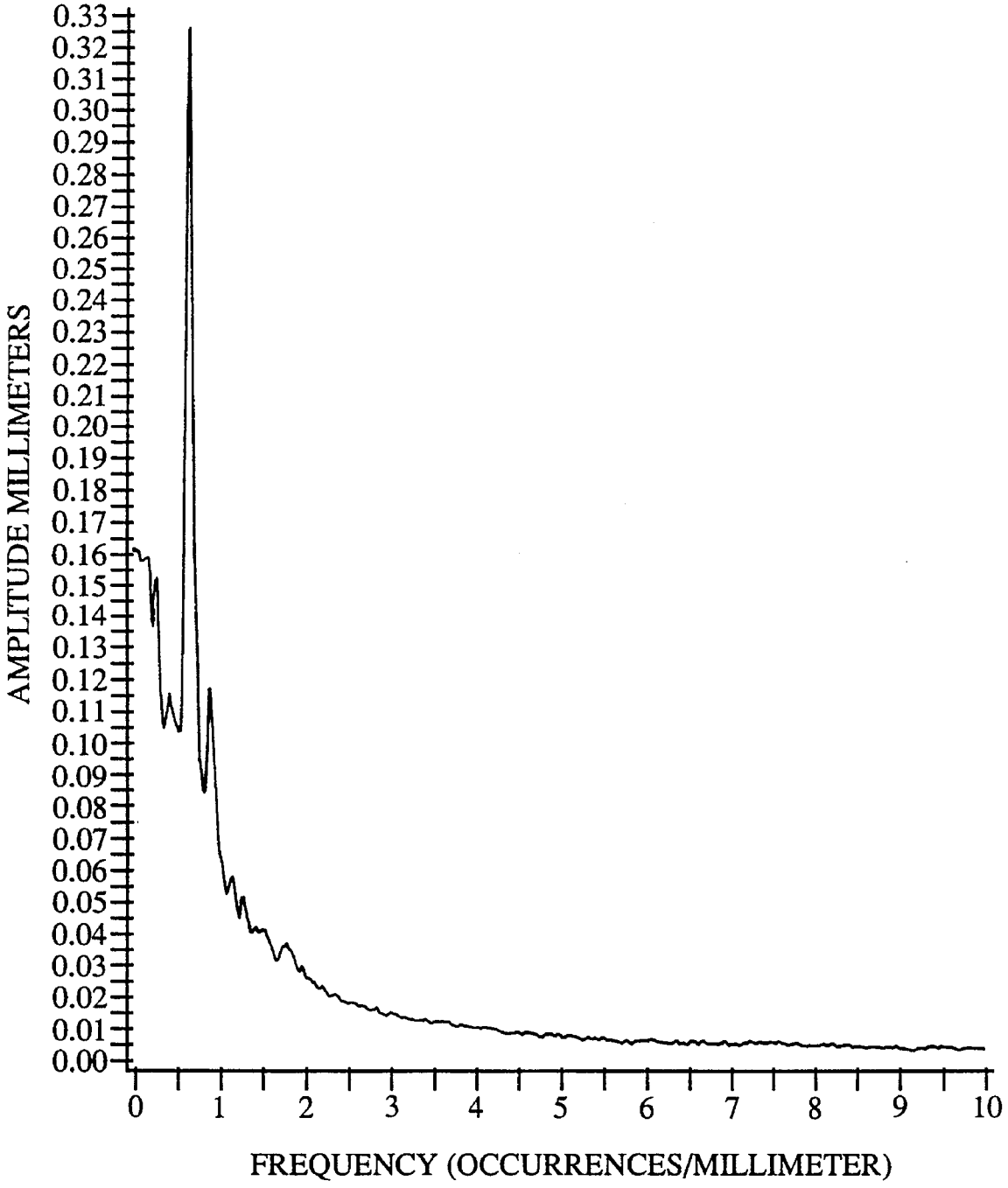
FIG. 18 is a Fourier transform of the isogram of FIG. 17.

For example, the Fourier transforms of FIGS. 16A, 16B and 18 show pitches (represented as peaks in the graphs of these FIGS.) of the occurrences per millimeters listed in Table V below. For ease of comparison, Table V also gives the values of the pitches of FIG. 18, discussed below.

TABLE V

| FIG. 16A | FIG. 16B | FIG. 18 |
|---|---|---|
| 0.117 | 0.156 | 0.156 |
| 0.352 | 0.234 | 0.234 |
| 0.469 | 0.391 | 0.391 |
| 0.625 | 0.625 | 0.625 |
| 0.859 | 0.859 | 0.859 |
| 1.250 | 1.133 | 1.132 |
| 1.406 | 1.250 | 1.250 |
| 1.523 | 1.445 | 1.406 |
| 1.758 | 1.719 | 1.523 |

These pitches corresponding to the size and distribution of the different regions 30, 32, 34 and 36 in the nonrandom repeating pattern. Knowing the pitches and sizes of the different regions 30, 32, 34 and 36 simplifies the other analyses specified hereunder, because the person conducting the tests knows the scale of the size of the regions 30, 32, 34 and 36 and the spacing of such regions 30, 32, 34 and 36.

The thicknesses of the regions 30, 32, 34 and 36 may be determined by digitally superimposing the two isograms, using the indicia to assure registration. Various single line tracings may be utilized to ascertain when registry is achieved, although it is to be recognized some trial and error may be necessary, due to the discrete nature of and finite distance between tracings. The superimposed data are then digitally subtracted. The difference between the isobasic data and isobathic data represent the thickness of the sample at the location. Since thickness is determined by the relative separation of the two surfaces, it does not matter which data are used as the minuend and subtrahend, because the absolute value of the difference represents the thickness.

Figure 17:
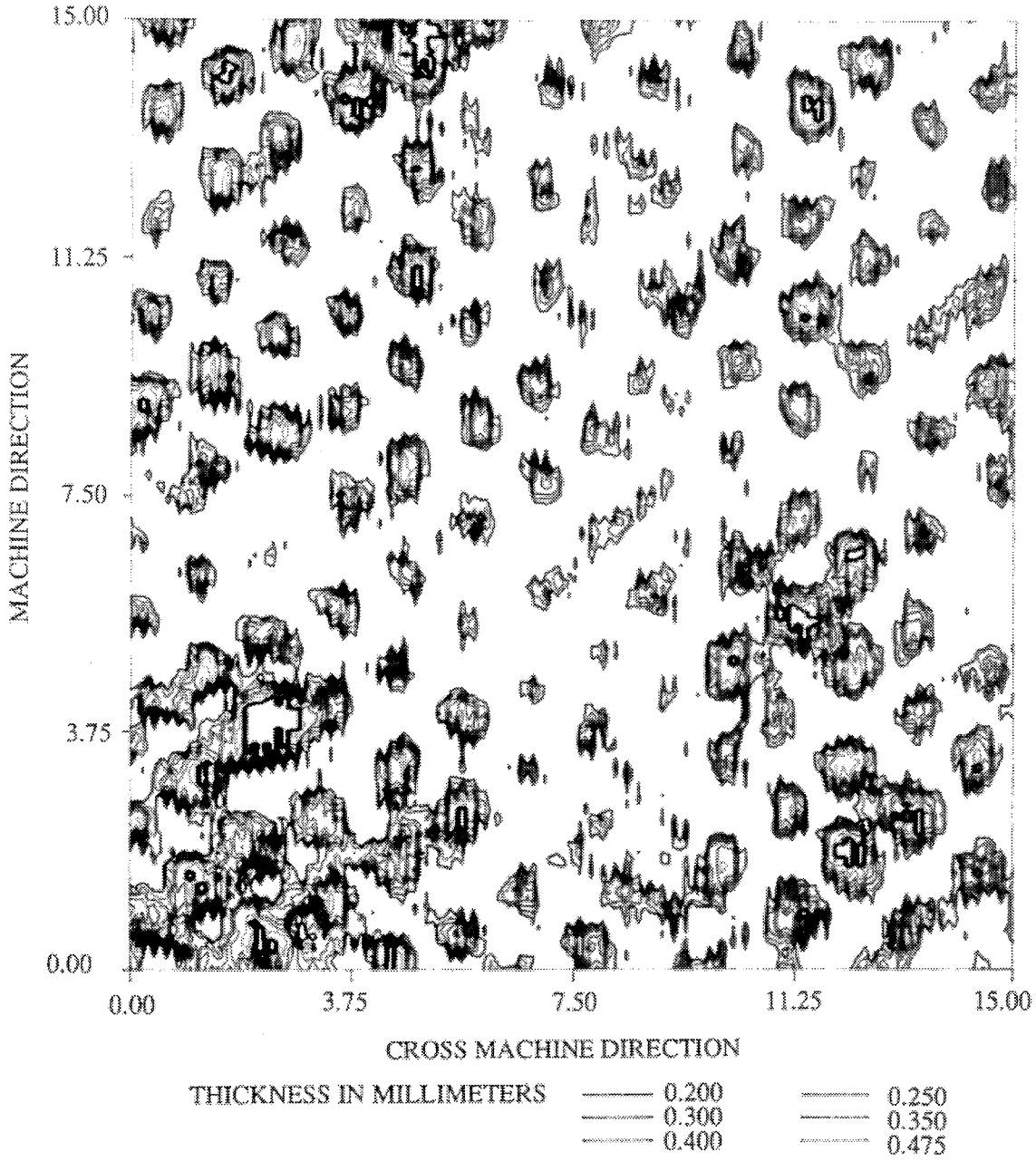
FIG. 17 is an isogram made by digitally subtracting FIG. 15B from FIG. 15A.

The thickness data may be plotted as isopachs, as illustrated in FIG. 17, to allow visual determination of whether or not a nonrandom repeating pattern is present. Of course, the isopachs may also be analyzed by a Fourier transform, as illustrated in FIG. 18 and tabulated in Table V above. The peaks at the pitches illustrated in Table V strongly indicate the presence of a nonrandom repeating pattern.

Another method to determine the thickness of various regions 30, 32, 34 and 36 of a sample of the fibrous structure 20 is by utilizing a stereoscan microscope. Any microscope capable of quantifying the elevational dimension of a structure, while viewing the structure normal to its plane may be used. A suitable microscope is a Cambridge 3-D Model 360 stereoscan electron microscope, made by the Leica Company, of Chicago, Ill.

A specially designed microscope stub is selected, having a recessed center circumscribed by a planar annular perimeter. The recess prevents altering the center of the sample from which the stub, by applying conductive adhesive to only the perimeter of the top surface of the stub, avoiding any contact or placement of the conductive adhesive with the center recess.

The tissue web is gently placed on the exposed surface of the adhesive and pressed in place. Care should be taken to keep the sample flat, wrinkle free, and parallel to the top planar annulus of the microscope stub. Two sample mountings are required for each thickness determination. The first sample is mounted with one side oriented upwards, and the second sample is mounted with the corresponding side of the sample downwardly oriented.

The sample should be visually scanned on the microscope to make a coarse identification of the number of unique nonrandom regularly repeating thicknesses. Each identified thickness should then be quantitatively determined.

Figure 4:
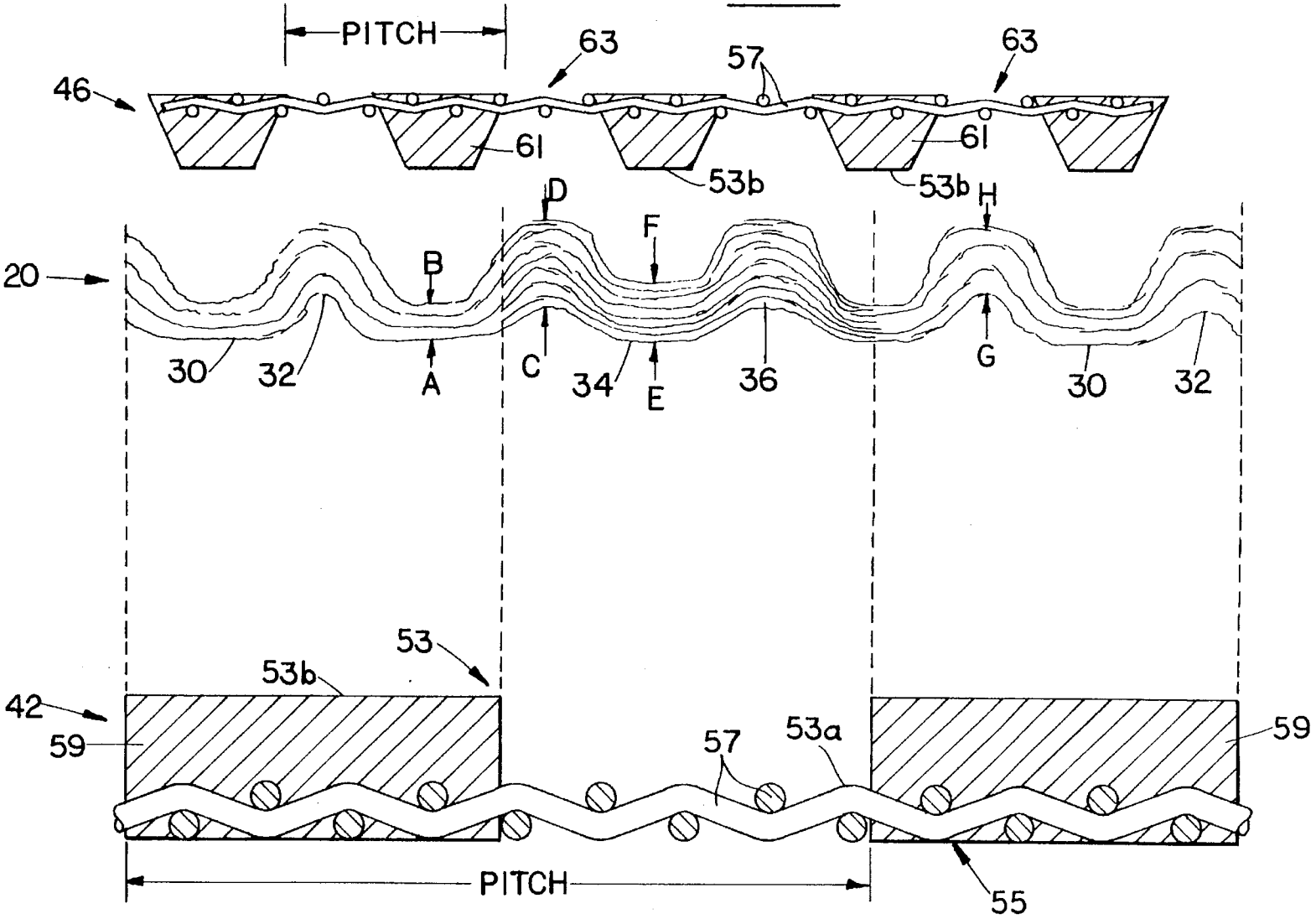
FIG. 4 is a fragmentary schematic sectional view of a four region fibrous structure according to the present invention, having an undulating surface of various thicknesses, the low basis weight regions being registered with the protuberances of the forming belt and the low density regions being registered with the noncoincident vacuum pervious regions of the secondary belt.

An exemplary case, illustrated by FIG. 4, has four regions of varying thickness, which are designated (AB), (CD), (EF) and (GH). To determine the four relevant thicknesses (AB), (CD), (EF), and (GH), one takes the sample having the first side oriented upwards and determines the elevational position of points B, D, F, and H relative to the top planar annulus of the stub. It will be understood that the planar annulus of the stub is coincident with the elevational position of points A and E. This step may be accomplished using the 3-dimensional capabilities of the microscope. Using the other sample, having the corresponding surface downwardly oriented, the elevational position of points G and C, relative to the elevational position of either point A or E is determined.

The two preceding steps are repeated for at least ten (or more if necessary to assure statistical significance) unique sites at each region, and all like data are averaged. It is not necessary to look at exactly the same site on each surface. Instead random selection of the ten (or more) sites on each of the samples will promote representative characterization of the samples.

The thickness of each region is given by the relative difference in elevational position of vertically registered points from the planar annulus and may be determined by subtracting the elevational positions noted above. For example, the thickness at (AB) is found by subtracting the elevational position of point A form the elevational position of point B. Similarly, the thickness at (EF) is found by subtracting the elevational position of point E from the elevational position of point F.

The thickness at (CD) is found by subtracting the elevational position of point A from the elevational position of point D (from the first sample). From this value is subtracted the value of the elevational position of point C minus the elevational position of point A (from the second sample). Similarly, the thickness at (GH) is found by subtracting the elevational position of point E from the elevational position of point G, (from the first sample). From this value is subtracted the value of the elevational position of point H minus the elevational position of point E (from the second sample).

If is not desired to use a stereoscan microscope, the determination of the thickness of various regions of the sample may be made by confocal laser scanning microscopy. Confocal laser scanning microscopy may be made using any confocal scanning microscope capable of measuring the dimension normal to the plane of the sample. A Phoibos 1000 Model microscope made by Sarastro Inc., of Ypsilanti, Mich., should be suitable for this purpose.

Using the Sarastro Confocal Scanning Microscope, a sample centimeters of the fibrous structure 20 is placed on top of a glass microscope slide. The microscope slide is placed under the objective lens and viewed under relatively low magnification (approximately 40×). This magnification enlarges the field of view sufficient that the number of surface features is maximized. When viewing at tis lower magnification, one should focus on the uppermost portion of the sample.

Preferably, by utilizing the fine focus adjustment of the microscope and the Z axis reading displayed on the monitor of the microscope, the microscope stage is lowered approximately 100 micrometers. The optical image output of the microscope is transferred from the oculars to the optical bench. This transfer changes the image output from the eyes of the operator to the detector of the microscope.

With the microscope computer, the step size and number of sections is now input. For the samples illustrated in FIGS. 1–3B, a step size of about 40 micrometers and a number of 20 sections have been found suitable. These parameters result in the acquisition of 20 optical XY slices at an interval of 40 micrometers, for a total depth of 800 micrometers normal to the plane of the sample.

Such settings allow optical sections to be acquired from slightly above the top surface of the sample of the fibrous structure 20, to slightly below the bottom surface of the sample of the fibrous structure. It will be apparent to one skilled in the art, that if higher resolution is desired, a smaller step size and a larger number of steps is required.

Using these settings, one begins the scanning process. The computer of the microscope will require the desired number of XY slices at the desired interval. The digitized data from each slice is stored in the memory of the microscope.

To obtain the measurements of interest, each slice is viewed on the computer monitor to determine which slice offers the most representative view of the features of interest, particularly the thickness of the sample. While viewing the slice of the sample which best illustrates the various thickness of the sample, a line is drawn through the region 30, 32, 34 or 36 of interest of a sample similar to that illustrated in FIG. 2. The XY function of the microscope is utilized so that a cross sectional view of the line is displayed. This cross sectional view is made up of all of the slices taken of the sample.

To measure the thickness, two Z axis points of interest are entered. For example, to measure the thickness of a region 30, 32, 34 or 36, the two points would be entered, one on each opposed surface of the sample.

If one does not desire to use a stereoscan microscope or a confocal laser scanning microscope to determine the thickness of the sample, reference microtomes may be made to determine the thickness of the sample. To determine the differential thickness of the fibrous structure 20 using reference microtomes, a sample measuring about 2.54 centimeters by 5.1 centimeters (1 inch by 2 inches) is provided and stapled onto a rigid cardboard holder. The cardboard holder is placed in a silicon mold. A mixture of six parts Versamid resin, four parts Epon 812 resin and 3 parts of 1,1,1-trichloroethane are mixed in a beaker. The resin mixture is placed in a low speed vacuum desiccator and the bubbles removed.

The mixture is then poured into the silicon mold with the cardboard sample holder so that the sample is thoroughly wetted and immersed in the mixture. The sample is cured for at least 12 hours and the resin mixture hardened. The sample is removed from the silicon mold and the cardboard holder removed from the sample.

The sample is marked with a reference point to accurately determine where subsequent measurements are taken. Preferably, the same reference point is utilized in both the plan view and various sectional views of the same of the fibrous structure 20.

A resolution guide may be utilized to mark the reference point. The resolution guide may be generally planar and laid on top of the sample prior to resin curing and/or photographing. A resolution guide having contrasting indicia radiating outwardly and, preferably, tangentially expanding is suitable. A ™1-t resolution guide made by Stouffer Graphic Arts Equipment Co., of South Bend, Ind. has been found particularly well suited for this purpose. The resolution guide is overlaid on the sample and, preferably, oriented so that the major axes of the indicia are aligned with the edges of the sample or with any pattern apparent in the sample.

The sample is placed in a model 860 microtome sold by the American Optical Company of Buffalo, N.Y. and leveled. The edge of the sample is removed from the sample, in slices, by the microtome until a smooth surface appears.

A sufficient number of slices are removed from the sample, so that the various regions 30, 32, 34 and 36 may be accurately reconstructed. For the embodiment described herein, slices having a thickness of about 100 microns per slice are taken from the smooth surface. At least about 10 to 20 slices are required, so that differences in the thickness of the fibrous structure 20 may be ascertained.

Three to four samples made by the microtome are mounted in series on a slide using oil and a cover slip. The slide and the sample are mounted in a light transmission microscope and observed at about 40× magnification. Pictures are taken to reconstruct the profile of this slice until all 10 to 20 slices, in series, are photographed. By observing the individual photographs of the microtome, differences in thickness may be ascertained as a profile of the topography of the fibrous structure is reconstructed. By knowing the relative basis weight at the reference point and at discrete regions 30, 32, 34 or 36 radiating from the reference point and the differences in thickness, qualitative differences in density may be ascertained.

The differences in thickness between regions 30, 32, 34 and 36 may be easily established by photographing any representative slice of the sample with a scale superimposed on the filed. Comparing the scale to the extremes of the sample at each outwardly oriented face of the fibrous structure 20, the thickness of the regions 30, 32, 34 or 36 under consideration is readily ascertained. By photographing the sample and resolution guide in the plan view, the orientation and one of width or spacing of the indicia at any location of the sample can be found and matched with the microtomes, to ascertain the particular region 30, 32, 34 or 36 for which a thickness measurement was made. The reference guide may also be utilized with the aforementioned soft X-ray procedure, so that precise determination of the regions 30, 32, 34 or 36, under consideration in the thickness measurement, is possible in place of the fibrous structure.

Alternatively, thickness differences may be ascertained using the stereoscan microscope in accordance with the teachings of any of the following articles: A Dynamic Real Time 3-D Measurement Technique for IC Inspection by Breton, et. al., published in Microelectronic Engineering (541–545 1986); Integrated Circuit Metrology, Inspection and Process Control by Breton, et. al. published in the Proceedings of SPIE-International Society for Optical Engineering (Vol. 775, March, 1987); or Real time 3D SEM imaging and measurement technique by Breton et. al., published in the European Journal of Cell Biology (Vol. 48, Supp. 25 1989), which articles are incorporated herein by reference for the purpose of showing alternative techniques for ascertaining thickness differences.

A technique for determining relative differences in density between various regions 30, 32, 34 and 36 of the fibrous structure is to utilize two other known intensive properties. Particularly, the ratio of the basis weight of the high basis weight regions 34 and 36 to the basis weight of the low basis weight regions 30 and 32 can be found as described above. Similarly, the ratio of the thicknesses of the high basis weight regions 34 and 36 to the thickness of the low basis weight regions can be found as described above.

Thus, it will be apparent to one skilled in the art that the ratio of the basis weights divided by the ratio of the thicknesses will yield the ratio of the densities between the high density regions 28 and the low density regions 24 and 26, providing the fibrous structure 20 is prepared in accordance with the teachings of this invention. Algebraically this may be expressed as:

$$\text{Density} = \text{Basis Weight/Thickness}$$

$$R_{BW} = \frac{\text{Basis Weight of the High Basis Weight Regions 34 and 36}}{\text{Basis Weight of the Low Basis Weight Regions 26}}$$

where $R_{BW}$ is the ratio of the basis weights. Similarly, $$R_T = \frac{\text{Thickness of the High Basis Weight Regions 34 and 36}}{\text{Thickness of the Low Basis Weight Regions 26}}$$

Thickness of the Low Basis Weight Regions 26 wherein $R_T$ is the ratio of the thicknesses of the high basis weight regions 34 and 36 to the low basis weight regions 30 and 32. Therefore, $$R_\Delta = R_{BW}/R_T$$

wherein $R_\Delta$ is the ratio of the densities of the high basis weight regions 34 and 36 to the density of the low basis weight regions 30 and 32.

It will be apparent to one skilled in the art that if the basis weight is held constant, the ratio of the thicknesses will be identical to the ratio of the densities for any particular regions 30, 32, 34 or 36. Thus, if one can establish that the regions 30, 32, 34 and 36 are of constant basis weight, by merely establishing the ratio of the thicknesses, as described above, one can at the same time establish the ratio of the densities, $R_{66}$. If this ratio, $R_{66}$, is less than 0.75 or greater than 1.33, the densities vary by more than 25%

Projected Average Pore Size

To quantify relative differences in projected average pore size, a Nikon stereomicroscope, model SMZ-2T sold by the Nikon Company, of New York, N.Y. may be used in conjunction with a C-mounted Dage MTI model NC-70 video camera. The image from the microscope may be stereoscopically viewed through the oculars or viewed in two dimensions on a computer monitor. The analog image data from the camera attached to the microscope may be digitized by a video card made by Data Translation of Marlboro, Mass. and analyzed on a MacIntosh IIx computer made by the Apple Computer Co. of Cupertino, Calif. Suitable software for the digitization and analysis is IMAGE, version 1.31, available from the National Institute of Health, in Washington, D.C.

The sample is viewed through the oculars, using stereoscopic capabilities of the microscope to determine areas of the sample wherein the fibers are substantially within the plane of the sample and other areas of the sample which have fibers deflected normal to the plane of the sample. It may be expected that the areas having fibers deflected normal to the plane of the sample will be of lower density than the areas having fibers which lie principally within the plane of the sample. Two areas, one representative of each of the aforementioned fiber distributions, should be selected for further analysis.

For the user's convenience identifying the areas of the sample of interest, a hand held opaque mask, having a transparent window slightly larger than the area to be analyzed, may be used. The sample is disposed with an area of interest centered on the microscope stage. The mask is placed over the sample so that the transparent window is centered and captures the area to be analyzed. This area and the window are then centered on the monitor. The mask should be removed so that any translucent qualities of the window do not offset the analysis.

While the sample is on the microscope stage, the backlighting is adjusted so that relatively fine fibers become visible. The threshold gray levels are determined and set to coincide with the smaller sized capillaries. A total of 256 gray levels, as described above, has been found to work well, with 0 representing a totally white appearance, and 255 representing a totally black appearance. For the samples described herein, threshold gray levels of approximately 0 to 125 have been found to work well in the detection of the capillaries.

The entire selected area is now bicolored, having a first color represent the detected capillaries as discrete particles and the presence of undetected fibers represented by gray level shading. This entire selected area is cut and pasted from the surrounding portion of the sample, using either the mouse or the perfect square pattern found i the software. The number of thresholded gray level particles, representing the projection of capillaries which penetrate through the thickness of the sample, and the average of their sizes (in units of area) may be easily tabulated using the software. The units of the particle size will either be in pixels or, if desired, may be micrometer calibrated to determine the actual surface area of the individual capillaries.

This procedure is repeated for the second area of interest. The second area is centered on the monitor, then cut the pasted from the balance of the sample, using the hand-held mask as desired. Again, the thresholded particles, representing the projection of capillaries which penetrate through the thickness of the sample, are counted and the average of their sizes tabulated.

Any difference in the average projected average pore size is now quantified. If the average size of the particles of the two areas differs by more than 25%, the intensive properties of the areas, likewise are considered to vary more than 25%.

Pattern Determination

Knowing the size and pitch of different regions 30, 32, 34 and 36 distinguished according to basis weight and thickness (and hence density or projected average pore size) allows one to determine whether or not a nonrandom repeating pattern exists in the fibrous structure 20, sufficient to define at least three different regions 30, 32, 34 and 36. If either the size or pitch of the thickness and basis weight measurements is different from the other, at least three regions 30, 32, 34 and 36 are present.

If the size or pitch are identical, then at lest three regions 30, 32, 34 and 36 are present, providing the parameters are not matched in location on the fibrous structure 20, in which case only two regions 24' and 26' are present. Matched location can typically be determined by visual inspection of the sample under magnification. If a more accurate or quantitative determination is desired, it may be made using the aforementioned indicia to assure registration.

Of course, it is to be recognized the aforementioned analytical procedures, are merely suggestions as to what procedures may be used to identify differences in intensive properties of a particular fibrous structure 20 under consideration. It will be recognized by one skilled in the art other, viable analytical procedures may exist and the final choice of which analytical procedure is to be used is best tempered by matching the state of the art to the particular sample under consideration.

THE APPARATUS AND PROCESS

Figure 5:
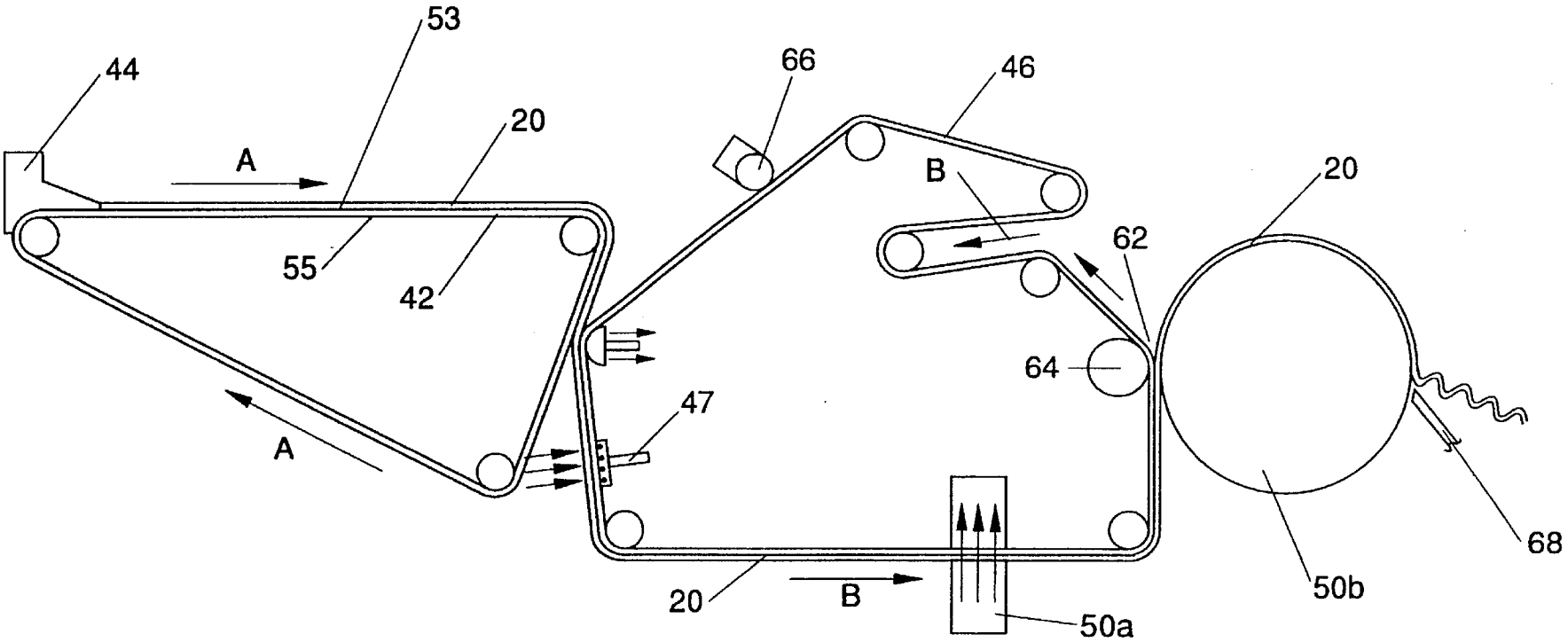
FIG. 5 is a schematic representation of one embodiment of a continuous papermaking machine which utilizes the steps of the process according to the present invention having the protuberances and projections of the forming and secondary belts, respectively, omitted for clarity.

A cellulosic fibrous structure 20 as described above may be made according to the apparatus illustrated by FIG. 5 and the process comprising the steps of providing the fibrous slurry, providing a liquid pervious fiber retentive forming element, which retains the fibers in a substantially planar geometry, providing a means 44 to deposit the fibrous slurry on the forming element, providing a means to apply a differential pressure to selected portions the fibrous slurry in concert with a differential pressure cooperating member, and providing a means **50*a* and/or 50*b* to dry the fibrous slurry. The process may be carried out using a suitably modified papermaking machine, having a forming belt 42 as the liquid pervious fiber retentive forming element. The deposited fibrous slurry will eventually form one of the aforementioned cellulosic structures 20 of FIGS. 2 or 3A and 3**B.

The provided fibrous slurry comprises an admixture of fibers, including, as desired, cellulosic and noncellulosic fibers, in a liquid carrier. Preferably, but not necessarily, the liquid carrier is aqueous. The fibers are normally dispersed in a substantially homogeneous fashion at a consistency of about 0.1 percent consistency to about 0.3 percent consistency. As used herein "consistency" is the ratio of the weight of dry fibers in the system to the total weight of the system multiplied by 100. As the steps in the process described below are serially carried out, the consistency of the admixture generally increases.

It is to be understood, of course, some fibers, particularly those of shorter length, may be carried through the forming element with the drainage of the liquid carrier and the forming element is still to be considered fiber retentive. However, this does not substantially adversely affect this step of the process. The forming element may comprise perforated films, rolls, or plates. A particularly preferred forming element is a continuous forming belt 42 illustrated by FIG. 6.

Figure 7:
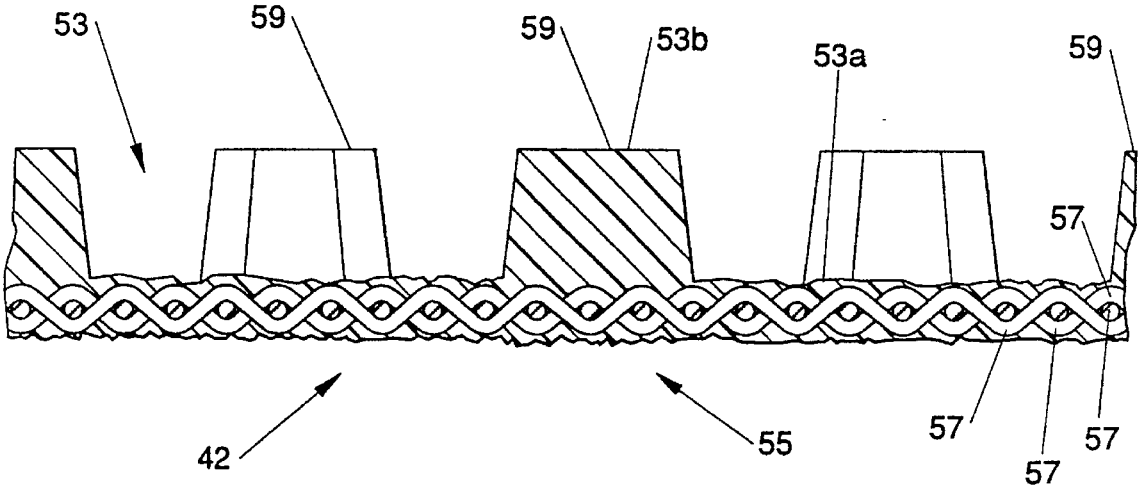
FIG. 7 is an enlarged fragmentary vertical sectional view of the belt of FIG. 6 taken along line 7—7 of FIG. 6.

If a forming belt 42 is selected for the forming element, the forming belt 42 has two mutually opposed faces, a first face 53 and a second face 55, as illustrated in FIG. 7. The first face 53 is the surface of the forming belt 42 which contacts the fibers of the cellulosic structure 20 being formed. The first face 53 has been referred to in the art as a paper contacting side of the forming belt 42. The first face 53 has two topographically distinct regions **53*a* and 53*b*. The regions 53*a* and 53*b* are distinguished by the amount of orthogonal variation from the second and opposite face 55 of the forming belt 42. Such orthogonal variation is considered to be in the Z-direction. As used herein the "Z-direction" refers to the direction away from and generally orthogonal to the forming belt 42, considering the forming belt 42** as a planar, two-dimensional structure.

The forming belt 42 should be able to withstand all of the known stresses and operating conditions in which cellulosic, two-dimensional structures are processed and manufactured. A particularly preferred forming belt 42 may be made according to the teachings of U.S. Pat. No. 4,514,345 issued Apr. 30, 1985 to Johnson et al., and particularly according to FIG. 5 of Johnson et al., which patent is incorporated herein by reference for the purpose of showing a particularly suitable forming element for use with the present invention and a method of making such forming element.

The forming belt 42 is liquid pervious in at lest one direction, particularly the direction from the first face 53 of the belt, through the forming belt 42, to the second face 55 of the forming belt 42. As used herein "liquid pervious" refers to the condition where the liquid carrier of a fibrous slurry may be transmitted through the forming belt 42 without significant obstruction. It may, of course, be helpful of even necessary to apply a slight differential pressure to assist in transmission of the liquid through the forming belt 42 to insure that the forming belt 42 has the proper degree of perviousness.

It is not, however, necessary, or even desired, that the entire surface area of the forming belt 42 be liquid pervious. It is only necessary that the liquid carrier of the fibrous slurry be easily removed from the slurry leaving on the first face 53 of the forming belt 42 an embryonic fibrous structure 20 of the deposited fibers.

The forming belt 42 is also fiber retentive. As used herein a component is considered "fiber retentive" if such component retains a majority of the fibers deposited thereon in a macroscopically predetermined pattern or geometry, without regard to the orientation or disposition of any particular fiber. Of course, it is not expected that a fiber retentive component will retain one hundred percent of the fibers deposited thereon (particularly as the liquid carrier of the fibers drains away from such component) nor that such retention be permanent. It is only necessary that the fibers be retained on the forming belt 42, or other fiber retentive component, for a period of the sufficient to allow the steps of the process to be satisfactorily completed.

The forming belt 42 (or any other forming element) must also be able to act cooperatively with the means for applying a differential pressure to selected portions of the fibrous slurry. This cooperation assists in forming the fibrous structures 20, described above, having at least three intensively distinguishable regions 24, 26 and 28 as illustrated in FIG. 2; or at least four intensively distinguishable regions 30, 32, 34 and 36 as illustrated in FIGS. 3A and 3B. Thus, the forming belt 42, when used in cooperation with the balance of the apparatus, should also be able to induce nonrandom, regular patterned differences in the basis weight or density of the fibrous structure 20, although, as discussed below, such patterned differences may be induced by other components of the apparatus used in the manufacturing process as well.

As used herein an "embryonic fibrous structure" of fibers refers to fibers deposited onto the forming belt 42 and which are easily deformed in the Z-direction and which may, and most likely are, dispersed in and throughout a high percentage of the liquid carrier. By maintaining the embryonic fibrous structure 20 at a consistency of about 2 percent to about 35 percent, the deposited fibers are more compliant and more easily deflected in the Z-direction.

Referring again to FIG. 6, the forming belt 42 may be thought of as having a reinforcing structure 57 and a patterned array of protuberances 59 joined in face to face relation to the reinforcing structure 57 to define the two mutually opposed faces 53 and 55. The reinforcing structure 57 may comprise a foraminous element, such as a woven screen or other apertured framework. The reinforcing structure 57 is substantially liquid pervious and retains the protuberances 59 in the desired patters. A suitable foraminous reinforcing structure 57 is a screen having a mesh size of about 6 to about 50 filaments per centimeter (15.2 to 127 filaments per inch) as seen in the plan view, although it is to be recognized that warp filaments are often stacked, doubling the filament count specified above. The openings between the filaments may be generally square, as illustrated, or of any other desired cross-section. The filaments may be formed of polymeric strands, woven or nonwoven fabrics.

One face 55 of the reinforcing structure 57 may be essentially macroscopically monoplanar and comprises the outwardly oriented face 53 of the forming belt 42. The inwardly oriented face of the forming belt 42 is often referred to as the backside of the forming belt 42 and, as noted above, contacts the least part of the balance of the apparatus employed in a papermaking operation. The opposing and outwardly oriented face 53 of the reinforcing structure 57 may be referred to as the fiber-contacting side of the forming belt 42, because the fibrous slurry, discussed above, is deposited onto this face 53 of the forming belt 42.

The patterned array of protuberances 59 joined to the reinforcing structure 57 preferably comprises individual protuberances 59 joined to and extending outwardly from proximal elevation 53*a* of the outwardly oriented face 53 of the reinforcing structure 57 as illustrated in FIG. 7. The protuberances 59 are also considered to be fiber contacting, because the patterned array of protuberances 59 receives, and indeed may be covered by, the fibrous slurry as it is deposited upon the forming belt 42.

The protuberances 59 may be joined to the reinforcing structure 57 in any known manner, with a particularly preferred manner being joining a plurality of the protuberances 59 to the reinforcing structure 57 as a batch process incorporating a hardenable polymeric photosensitive resin—rather than individually joining each protuberance 59 of the patterned array of protuberances 59 to the reinforcing structure 57. The patterned array of protuberances 59 is preferably formed by manipulating a mass of generally liquid material so that, when solidified, such material is contiguous with the forms part of the protuberances 59 and at least partially surrounds the reinforcing structure 57 in contacting relationship, as illustrated in FIG. 7.

The patterned array of protuberances 59 should be situated so that a plurality of conduits, into which fibers of the fibrous slurry may deflect, extend in the Z-direction from the free ends 53*b* of the protuberances 59 to the proximal elevation 53*a* of the outwardly oriented face 53 of the reinforcing structure 57. This arrangement provides a defined topography to the forming belt 42 and allows for the liquid carrier and fibers therein to flow to the reinforcing structure 57 (or other framework to which the patterned array of protuberances 59 is joined), where the liquid may be drained away and the fibers may be rearranged in response to later applied differential pressure.

The protuberances 59 are discrete and preferably regularly spaced so that large scale weak spots in the essentially continuous network 24 of the fibrous structure 20 are not formed. Between adjacent protuberances 59 are conduits through which the carrier and fibers may drain to the reinforcing structure 57. More preferably, the protuberances 59 are distributed in a predetermined, nonrandom, repeating pattern so that the essentially continuous network 24 of the fibrous structure 20 (which is formed around the protuberances 59) more uniformly distributes applied tensile loading throughout the fibrous structure 20. Most preferably, the protuberances 59 are bilaterally staggered in an array, so that adjacent low basis weight regions 26 in the resulting fibrous structure 20 are not aligned with either principal direction to which tensile loading may be applied.

As illustrated in FIG. 7, the upstanding protuberances 59 are joined at their proximal ends to the outwardly oriented face 53 of the reinforcing structure 57 and extend away from this face 53 to a distal or free end 53*b* which defines the furthest orthogonal variation of the patterned array of protuberances 59 from the outwardly oriented face 53 of the reinforcing structure 57. Thus, the outwardly oriented face 53 of the forming belt 42 is defined at two elevations. The proximal elevation of the outwardly oriented face 53 is defined by the surface of the reinforcing structure 57 to which the proximal ends 53*a* of the protuberances 59 are joined, taking into account, of course, any material of the protuberances 59 which surrounds the reinforcing structure 57 upon solidification. The distal elevation of the outwardly oriented face 53 is defined by the free ends 53*b* of the patterned array of protuberances 59. The opposed and inwardly oriented face 55 of the forming belt 42 is defined by the other face of the reinforcing structure 57, taking into account, of course, any material of the protuberances 59 which surrounds the reinforcing structure 57 upon solidification, which face is opposite the direction of extend of the protuberances 59.

The protuberances 59 may extend, orthogonal the plane of the forming belt 42, outwardly from the proximal elevation of the outwardly oriented face 53 of the reinforcing structure 57 about 0 millimeters (occlusions in the openings between filaments) to about 1.3 millimeters, and preferably about 0.15 to about 0.25 millimeters. If the protuberances 59 have zero extent in the Z-direction, a more nearly constant basis weight fibrous structure 20 results. If it is desired to form an apertured fibrous structure 20, or a fibrous structure 20 of relatively high overall basis weight, then protuberances 59 generally extending further from the proximal elevation 53*a* of the outwardly oriented face 53 of the reinforcing structure 57 and having a greater dimension in the Z-direction should be utilized. Conversely, if it is desired to minimize the difference in basis weights between adjacent regions of the fibrous structure 20, generally shorter protuberances 59 should be utilized.

The tensile load carrying capability of the essentially continuous network is strongly influenced by the protuberances 59. The protuberances 59 preferably do not have sharp corners, particularly in the XY plane, so that stress concentrations in the resulting high basis weight regions 24 and 28 of FIG. 2 and 34 and 36 of FIGS. 3A and 3B of the fibrous structure 20 are obviated. A particularly preferred protuberance 59 is curvirhombohedrally shaped, having a cross-section which resembles a rhombus with radiused corners.

Without regard to the cross-sectional area of the protuberances 59, the sides of the protuberances 59 may be generally mutually parallel and orthogonal the plane of the forming belt 42. Alternatively, the side of the protuberances 59 may be somewhat tapered, yielding a frustroconical shape.

It is not necessary that the protuberances 59 be of uniform height or that the fee ends 53*b* of the protuberances 59 be equally spaced from the proximal elevation 53*a* of the outwardly oriented face 53 of the reinforcing structure 57. If it is desired to incorporate more complex patterns than those illustrated into the fibrous structure 20, it will be clearly understood by one skilled in the art that this may accomplished by having a topography defined by several Z-directional levels of upstanding protuberances 59—each level yielding a different basis weight than occurs in the regions of the fibrous structure 20 defined by the protuberances 59 of the other levels. Alternatively, this may be otherwise accomplished by a forming belt 42 having an outwardly oriented face 53 defined by more than two elevations by some other means, for example, having uniform sized protuberances 59 joined to a reinforcing structure 57 having a planarity which significantly varies relative to the Z-direction extent of the protuberances 59.

The patterned array of protuberances 59 may, preferably, range in projected surface area, as a percentage of the projected surface area of the forming belt 42, from a minimum of about 20 percent of the total projected surface area of the forming belt 42 to a maximum of about 80 percent of the projected total surface area of the forming belt 42, with the reinforcing structure 57 providing the balance of the projected surface area of the forming belt 42. The contribution of the patterned array of protuberances 59 to the total projected surface area of the forming belt 42 is taken as the aggregate of the projected area of each protuberance 59 taken at the maximum projection against and orthogonal to outwardly oriented face 53 of the reinforcing structure 57.

It is to be recognized that as the contribution of the protuberances 59 to the total projected surface area of the forming belt 42 diminishes, the previously described high basis weight essentially continuous network 24 of the fibrous structure 20 increases, minimizing the economic use of raw materials. Further, the projected surface area between adjacent protuberances 59 of the proximal elevation 53*a* of the forming belt 42 should be increased as the length of the fibers increases, otherwise the fibers may not cover the protuberances 59 and not penetrate the conduits between adjacent protuberances 59 to the reinforcing structure 57 defined by the projected surface area of the proximal elevation 53*a*.

The second face 55 of the forming belt 42 may have a defined and noticeable topography or may be essentially macroscopically monoplanar. As used herein "essentially macroscopically monoplanar" refers to the geometry of the forming belt 42 when it is placed in a two-dimensional configuration and has only minor and tolerable deviations from absolute planarity, which deviations do not adversely affect the performance of the forming belt 42 in producing cellulosic fibrous structures 20 as described above and claimed below. Either geometry of the second face 55, topographical or essentially macroscopically monoplanar, is acceptable, so long as the topography of the first face 53 of the forming belt 42 is not interrupted by deviations of larger magnitude, and the forming belt 42 can be used with the process steps described herein. The second face 55 of the forming belt 42 may contact the equipment used in the process of making the fibrous structure 20 and has been referred to in the art as the machine side of the forming belt 42.

Referring again to FIG. 5, also provided is a means 44 for depositing the fibrous slurry onto the liquid pervious forming belt 42, and more particularly onto the face 53 of the forming belt 42 having the discrete upstanding protuberances 59, so that the reinforcing structure 57 and the protuberances 59 are completely covered by the fibrous slurry unless a fibrous structure 20 having apertures for the low basis weight regions 26 is desired, in which case the topography defined by the free ends 53*b* of the protuberances 59 should not be covered with the deposited fibrous slurry. A headbox, as is well known in the art, may be advantageously used for this purpose. While several types of headboxes 44 are known in the art, one headbox 44 which has been found to work well is a conventional Fourdrinier headbox 44 which generally continuously applied and deposits the fibrous slurry onto the outwardly oriented face 53 of the forming belt 42.

The means 44 for depositing the fibrous slurry and the forming belt 42 are moved relative to one another, so that a generally consistent quantity of the slurry may be deposited on the forming belt 42 in a continuous process. Alternatively, the slurry may be deposited on the forming belt 42 in a batch process. Preferably, the means 44 for depositing the fibrous slurry onto the pervious forming belt 42 can be regulated, so that as the rate of differential movement between the forming belt 42 and the depositing means 44 increases or decreases, larger or smaller quantities of the fibrous slurry may be deposited onto the forming belt 42 per unit of time, respectively.

Also provided is a means 50*a* and/or 50*b* for drying the fibrous slurry from the embryonic fibrous structure 20 of fibers to form a two-dimensional fibrous structure 20 having a consistency of at least about 90 percent. Any convenient drying means 50*a* and/or 50*b* well known in the papermaking art can be used to dry the embryonic fibrous structure 20 of the fibrous slurry. For example, press felts, thermal hoods, infra-rad radiation, below-through dryers 50*a*, and Yankee drying drums 50*b*, each used alone or in combination, are satisfactory and well known in the art. A particularly preferred drying method utilizes a blow-through dryer 50*a*, and a Yankee drying drum 50*b* in sequence.

Also provided is a means to apply a differential pressure to selected portions of the fibrous structure 20. The differential pressure may cause densification or dedensification of the regions 28, 32 and 36 (FIG. 2, 3A and 3B) of the fibrous structure 20. The differential pressure may be applied to the fibrous structure 20 during any step in the process before too much of the liquid carrier is drained away, and is preferably applied while the fibrous structure 20 is still an embryonic fibrous structure 20. If too much of the liquid carrier is drained away before the differential pressure is applied, the fibers may be too stiff and not sufficiently conform to the topography of the patterned array of protuberances 59, thus yielding a fibrous structure 20 that does not have the described regions of differing basis weight.

As used herein a "differential pressure" means difference in net force per unit area across the opposed faces of the two-dimensional fibrous structure 20 and, preferably, is applied across the opposed faces 53 and 55 of the forming belt 42. The differential pressure is temporarily applied, and is not uniform across the entire face of the two-dimensional fibrous structure 20. Instead the differential pressure is only applied to selected regions 28, 32 and 36 (FIGS. 2, 3A and 3B) of the fibrous structure 20.

It is important that the selected regions 28, 32 and 36 (FIGS. 2, 3A and 3B, respectively) of the fibrous structure 20 to which the differential pressure is applied are not coincident the parent regions 24 and 26 (FIG. 2); or 30 and 34 (FIG. 3A and 3B) of the fibrous structure 20 defined by the topographical elevations 53*a* and 53*b* of the forming belt 42. More specifically, such selected regions 28, 32, and 36 should be noncoincident the topography defined by the two elevations 53*a* and 53*b* of the outwardly oriented face 53 of the forming belt 42, and hence noncoincident the variations in basis weights of the fibrous structure 20, by being different in either size, pitch, pattern (or any combination of size, pitch and pattern) to be noncoincident the topography of the forming belt 42.

For example, if the selected regions 28, 32, and 36 (FIGS. 2, 3A and 3B) subjected to the differential pressure are identical in size to the cross-section of the patterned array of protuberances 59 at the free ends 53*b* of the protuberances 59, but offset in either the machine direction, the cross machine direction, or both, the differential pressure will be applied noncoincident the topographical elevations 53*a* and 53*b* set forth by the forming belt 42. Similarly, if the selected regions 28, 32, and 36 (FIGS. 2, 3A and 3B) subjected to the differential pressure are larger than the cross-section of the free ends 53*b* of the protuberances 59, such selected regions 28, 32, and 36 (FIGS. 2, 3A and 3B) will be noncoincident the topographical elevations 53*a* set forth by the forming belt 42.

Of course, it is to be recognized that if the selected regions 28, 32, and 36 (FIGS. 2, 3A and 3B) subjected to the differential pressure are larger in area than the free ends 53*b* of the protuberances 59, some overlap of such selected regions 28, 32, and 36 into the essentially continuous network 24 of FIG. 2 and the network 34 of FIGS. 3A and 3B and into the low basis weight regions 26 and 32 of FIGS. 2, 3A and 3B will result. Such overlap is generally not harmful to the process described herein and the structure 20 resulting therefrom. Therefore, no special steps need be taken to avoid such overlap.

The differential pressure applied to the fibrous structure 20 may be mechanical compression, resulting from Z-directional interference of rigid member with the two-dimensional fibrous structure 20. Typically, such Z-directional interference reduces the thickness and causes densification of the interfered regions 28 to which such differential pressure was selectively applied. As illustrated in FIG. 5, one means for applying a compressive, densifying differential pressure to the selected regions 28, 32, and 36 (FIGS. 2, 3A and 3B) of the fibrous structure 20 is through the patterned array of upstanding protuberances 59.

It will be apparent to one skilled in the art that another component of the apparatus is necessary to resist the applied differential pressure—otherwise, the fibers to which the differential pressure is applied may break out of the fibrous structure 20, leaving undesired holes or tears. A component which resists the selectively applied differential pressure to cause densification or dedensification of selected regions 28, 32, and 36 (FIGS. 2, 3A and 3B) of the fibrous structure 20 is referred to as a differential pressure cooperating member. As described below, the differential pressure cooperating member may be a smooth rigid surface, such as may be found on an impression roll 64, a Yankee drying drum 50*b*, or may be another belt 46 having a defined topography.

As noted above, it is important that the differential pressure be selectively applied to regions 28, 32, and 36 of the fibrous structure 20 which do not identically correspond to the parent regions 24 and 36 of FIG. 2; or the parent regions 30 and 34 of the fibrous structure 20 of FIGS. 3A and 3B, which regions are defined by different basis weights, so that noncoincidence occurs. To make sure that coincidence does not occur and noncoincidence does occur, it may be necessary to transfer the fibrous structure 20 from the forming belt 42 (or other forming element) onto which the fibrous slurry was deposited to another component which may act to noncoincidentally selectively apply the differential pressure.

One preferred such component is a secondary belt 46, illustrated in FIG. 4, having vacuum pervious regions 63 and projections 61 which are not coincident the patterned array of protuberances 59 of the forming belt 42 on which the fibrous slurry was deposited, and hence not coincident the regions 24 and 26 of FIG. 2; or the regions 30 and 34 of FIGS. 3A and 3B, which regions represent the differing basis weights of the embryonic fibrous structure 20. The projections 61 of the secondary belt 46 may be continuous or discrete and joined to reinforcing structure 57. The free ends 53*b* of the projections 61 may be used to compress selected regions 28 of the fibrous structure 20 of FIG. 2 against the forming belt 42, causing densification of such regions 28 relative to the circumjacent high basis weight regions 24 of the two-dimensional fibrous structure 20 of FIG. 2.

It will be apparent to one skilled in the art that the low basis weight regions 26 of the fibrous structure 20 which are registered with the projections 61 of the secondary belt 46 will not be densified to the same degree as the higher basis weight regions 28 registered with the corresponding to the high basis weight regions 24 of the fibrous structure 20, because such lower basis weight regions 26 have fewer fibers, are more compliant, and may therefore deform to the topography set forth by the projections 61 and the differential pressure cooperating member without significant densification, rather than be compressed thereinbetween.

A secondary belt 46 having knuckles on the outwardly oriented face 53 and formed by overlapping warp and weft fibers, as is well known in the art, produces a pattern of projections 61 against the fibrous structure 20, which pattern statistically will not correspond in size or position to the pattern of low basis weight regions 26 and 30 of the fibrous structure of FIGS. 2, 3A and 3B caused by the protuberances 59 described relative to the first forming belt 42. A suitable secondary belt 46 for this purpose is described in U.S. Pat. No. 3,301,746 issued Jan. 31, 1967 to Sanford et al., which patent is incorporated herein by reference for showing a suitable differential pressure cooperating member for use in applying a differential pressure to the two-dimensional fibrous structure 20. Of course, by making very slight changes in the size or pitch of the projections 61 of the secondary belt 46, relative to the size and pitch of the protuberances 59 of the forming belt 42 onto which the fibrous slurry was deposited, one can virtually assure that the patterns will never correspond and noncoincidence is achieved.

Alternatively, the secondary belt 46 may be made of a patterned array of projections 61, and other suitable framework, and reinforcing structure 57 construction, similar or identical to that used for the first forming belt 42. In yet another alternative, the projections 61 of the secondary belt 46 may form an essentially continuous network, as disclosed in U.S. Pat. No. 4,528,239 issued Jul. 9, 1985 to Trokhan and incorporated herein by reference for the purpose of showing another secondary belt 46 suitable as a differential pressure cooperating member.

The projections 61 of the secondary belt 46 may be smaller in surface area than the upstanding protuberances 59 of the forming belt 42 (or other forming element) onto which the fibrous slurry was originally deposited. By having the upstanding projections 61 of the secondary belt 46 smaller in surface area than the protuberances 59 of the forming belt 42 (or other forming element) the discrete densified regions 28 of the fibrous structure 20 of FIG. 2 will likely not bridge regions of the essentially continuous network 24 maintaining flexibility. Alternatively, if the projections 61 of the secondary belt 46 are larger in surface area than the protuberances 59 of the first forming belt 42, larger densified regions 28 may be expected, and a fibrous structure 20 having greater tensile strength is typically formed at the loss of flexibility.

Similarly, the pitch of the projections 61 of the secondary belt 46 should be less than the pitch of the protuberances 59 of the forming belt 42 or other forming element. If the pitch of the projections 61 of the secondary belt 46 is less than the pitch of the protuberances 59 of the forming belt 42 or other forming element, a more closely spaced pattern of densified regions 28 results and a generally higher tensile strength fibrous structure 20 is formed. It is generally not desired that the entire high basis weight essentially continuous network 24 of the fibrous structure 20 be densified, as this results in a stiffer, less absorbent fibrous structure 20.

The fibrous structure 20 may be directly transferred from the forming belt 42 to a secondary belt 46 using conventional and well known techniques. The secondary belt 46 projections 61 then compress selected regions 28 of the fibrous structure 20 against the differential pressure cooperating member. In such an arrangement, a nip 62 may be defined between an impression roll 64 and a juxtaposed smooth surface Yankee drying drum 50*b*, as is well known in the art. The fibrous structure 20 passes through the nip 62 formed between the impression roll 64 and the Yankee drying drum 50*b*. In this nip 62, the protuberances of the secondary belt 46 compress the regions 28 of the fibrous structure 20 registered with the projections 61 against the rigid surface of the Yankee drying drum 50*b*, causing such registered regions 28 of the fibrous structure 20 to be densified.

Furthermore, the steps of applying a differential pressure to selected regions 28, 32, and 36 of the fibrous structures 20 (FIGS. 2, 3A and 3B) and the steps of drying the fibrous structures 20 may be advantageously combined. Particularly, if a Yankee drying drum 50*b* is used to dry the fibrous structure 20, the surface of the Yankee drying drum 50*b* may also be utilized to impart a differential pressure to selected regions of the fibrous structure 20.

To accomplish the application of differential pressure concurrent with drying, the two-dimensional fibrous structure 20 is transferred to a secondary belt 46 having a topography different than that of the forming belt 42 onto which the fibrous slurry was originally deposited so that noncoincidence is achieved. The secondary belt 46 may be juxtapose with the Yankee drying drum 50*b* to define a nip 62 therebetween. The fibrous structure 20 is passed through the nip 62, is compressed in selected regions 28, as described above, while being transferred to the Yankee drying drum 50*b* where drying occurs.

If the process further comprising the steps of transferring the two-dimensional fibrous structure 20 to a secondary belt 46, or other differential pressure cooperating member, is selected, providing again that the topography of such secondary belt 46 does not correspond in pattern to the forming belt 42, a four intensively distinguished region fibrous structure 20 may be formed, as illustrated in FIGS. 3A, 3B and 4. This fibrous structure 20 occurs through the application of a differential fluid pressure to selected regions 32 and 36 of the fibrous structure 20. Instead of the compressive mechanical interference differential pressure described above, the applied differential pressure may be a fluid pressure, such as a positive pressure imparted by air, steam, or some other fluid to the outwardly oriented face of the two-dimensional fibrous structure 20 while it is on the forming belt 42.

Alternatively, the fluid pressure may be subatmospheric. If the fluid pressure is subatmospheric, it may be applied by a vacuum administered to the fibrous structure 20. The vacuum may be applied to the inwardly oriented face 55 of the reinforcing structure 57 of the vacuum pervious regions 63 of the secondary belt 46, as illustrated in FIG. 5. The use of a vacuum box 47, as is well known in the art, may be satisfactorily employed as a means to apply a differential fluid pressure to the fibrous structure 20. Further, the use of a vacuum box 47 for this purpose advantageously deflects fibers in the embryonic fibrous structure 20 into conformance with the topography of the secondary belt 46.

Applying a differential fluid pressure, particularly a subatmospheric fluid pressure, to selected regions 32 and 36 of the fibrous structures 20 of FIGS. 3A and 3B decreases the density of such regions 32 and 36 by expanding the fibers of the parent regions 30 and 34, respectively, in the Z-direction. This step results in a thicker, softer, more absorbent cellulosic fibrous structure 20.

As noted above, it is important to apply the differential pressure to regions 32 and 36 of the two-dimensional fibrous structure 20 which do not identically correspond to the above described parent high basis weight regions 34 (of low basis weight regions 30) so that noncoincidence is maintained. Therefore, it may be desirable to transfer the fibrous structure 20 to a differential pressure cooperating member, such as a secondary belt 46, having vacuum pervious regions 63, such as apertures, which are not coincident, in at least one of size, pattern, and pitch, of the parent high and low basis weight regions 30 and 34, noted above, of the fibrous structure 20.

The differential fluid pressure is transferred to the fibrous structure 20 through the noncoincident vacuum pervious regions 63 of the secondary belt 46. Preferably, such vacuum pervious regions 63 are discrete, so that an essentially continuous network of low density regions 32 and 36 does not result, and a decrease in the tensile strength of the fibrous structure 20 can be obviated. Also such vacuum pervious regions 63 of the belt 46 should be disposed in a nonrandom, regular repeating pattern so that tensile strength variations throughout the fibrous structure 20 are minimized.

If a secondary belt 46 is selected for the differential pressure cooperating member, it may be patterned with an essentially discontinuous vacuum impervious network, so that such pattern may be transferred to the fur region fibrous structure 20 to be formed, further increasing its tensile strength. If this further processing step is selected, a very suitable secondary belt 46 to which the fibrous structure 20 may be transferred is described in U.S. Pat. No. 4,528,239 issued Jul. 9, 1985 to Trokhan, which patent is incorporated herein by reference for the purpose of showing a particularly suitable vacuum pervious differential pressure cooperating member.

It will be apparent to one skilled in the art that the high basis weight regions 34 and low basis weight regions 30 of the fibrous structure 20 transferred to the secondary belt 46 statistically will not register with the pervious regions in such secondary belt 46. When a subatmospheric differential fluid pressure or a positive differential fluid pressure is applied to the fibrous structure 20 while on the secondary belt 46, the vacuum pervious regions 63 of the secondary belt 46 coincident with both the high basis weight regions 36 and low basis weight regions 32 of the fibrous structure 20 will be subjected to the differential pressure, causing dedensification of such subjected regions 36 and 32 to occur, as illustrated i the fibrous structure 20 of FIGS. 3A and 3B.

This step results in a four region fibrous structure 20 (even without the aforementioned step of applying a compressive differential pressure to selected regions 28 of the fibrous structure 20). Two of the four regions 30 and 32 result from the low basis weight parent regions 30 of the fibrous structure 20, i.e., low basis weight regions 32 subjected to and low basis weight regions 30 not subjected to the selectively applied differential pressure, respectively. Two of the four regions 34 and 36 result from the high basis weight parent regions 34 of the fibrous structure 20. i.e., high basis weight regions 36 subjected to and high basis weight regions 34 not subjected to the selectively applied differential pressure, respectively.

It will be apparent to one skilled in the art that multiple vacuum boxes 47 may be utilized in seriatum to apply different amounts of differential fluid pressure to the fibrous structure 20, so that more than four (e.g., six, eight, etc.) regions of differing densities and basis weights may be formed. Of course, if a fibrous structure 20 having more than two dedensified regions is to be formed, the fibrous structure 20 must be shifted relative to the vacuum pervious regions 63 of the secondary belt 46, as for example, by transferring the fibrous structure 20 to a different secondary belt 46. Optionally, the further step of compressing other selected portions of the fibrous structure 20 may be employed before or after the stop of applying the differential fluid pressure to further increase the total number of intensively distinguished regions 30, 32, 34 and 36 in the fibrous structure 20.

Thus, it will be apparent to one skilled in the art that the application of differential pressure to selected regions 28, 32, and 36 of the fibrous structure 20 of FIGS. 2, 3A and 3B can result in either discrete or essentially continuous regions of greater density (region 28) or of lesser density (regions 32 and 36) than that of the parent regions 24, 30 or 34 subjected to such differential pressure—dependent upon whether the selectively applied differential pressure is compressive (such as mechanical interference) or draws the fibers away from the plane of the fibrous structure 20 (such as a fluid pressure).

If desired, the apparatus according to the present invention may further comprise an emulsion roll 66, as shown in FIG. 5. The emulsion roll 66 distributes an effective amount of a chemical compound to either forming belt 42 or, if desired, to the secondary belt 46 during the process described above. The chemical compound may act as a release agent to prevent undesired adhesion of the fibrous structure 20 to either forming belt 42 or to the secondary belt 46. Further, the emulsion roll 66 may be used to deposit a chemical compound to treat the forming belt 42 or secondary belt 46 and thereby extend its useful life. Preferably, the emulsion is added to the outwardly oriented topographical faces 53 of the forming belt 42 or secondary belt 46 when such forming belt 42 or secondary belt 46 does not have the fibrous structure 20 in contact therewith. Typically, this will occur after the fibrous structure 20 has been transferred from the forming belt 42 to the secondary belt 46, or from the secondary belt 46 to the Yankee drying drum 50*b* and the forming belt 42 or the secondary belt 46 is on the return path.

Preferred chemical compounds for emulsions include compositions containing water, high speed turbine oil known as Regal Oil sold by the Texaco Oil Company of Houston, Tex. under product number R&O 68 Code 702; dimethyl distearyl ammioniumchloride sold by the Sherex Chemical Company, Inc. of Rolling Meadows, Ill. as ADOGEN TA100; cetyl alcohol manufactured by the Procter & Gamble Company of Cincinnati, Ohio; and an antioxidant such as is sold by American Cynamid of Wayne, N.J. as Cyanox 1790.

Also, if desired, cleaning showers or sprays (not shown) may be utilized to cleanse the forming belt 42 and secondary belt 46 of fibers and other residues remaining after the fibrous structure 20 is transferred to the Yankee drying drum 50*b* or so removed from any forming element and any differential pressure cooperating member.

An optional, but highly preferred step in either aforementioned process of forming a cellulosic fibrous structure 20 having at least three regions 24, 26, and 28 or having four regions 30, 32, 34, and 36 (FIGS. 2, 3A and 3B) is foreshortening the fibrous structure 20 after it is dried. As used herein, "foreshortening" refers to the step of reducing the length of the fibrous structure 20 by rearranging the fibers and disrupting fiber-to-fiber bonds. Foreshortening may be accomplished in any of several well known ways, the most common and preferred being creping.

The step of creping may be accomplished in conjunction with the step of drying, by utilizing the aforementioned Yankee drying drum 50*b*. In the creping operation, the cellulosic fibrous structure 20 is adhered to a surface, preferably the Yankee drying drum 50*b* and then removed from that surface with a doctor blade 68 by the relative movement between the doctor blade 68 and the surface to which the fibrous structure 20 is adhered. The doctor blade 68 is oriented with a component orthogonal the direction of relative movement between the surface and the doctor blade 68, and is preferably substantially orthogonal thereto.

It will be apparent that several combinations, permutations, orders and sequences of the foregoing steps, structures and apparatus are possible, all of which are within the scope of the claimed invention. For example, two laminae of cellulosic fibrous structures 20 may be joined in face to face relationship, to form a two ply cellulosic fibrous laminate. Alternatively, a single lamina fibrous structure 20 according to the present invention may be joined in face to face relationship with a lamina of a fibrous structure 20'0 according to the prior art (or with a lamina heretofore unknown) to form a two ply cellulosic fibrous laminate. All such laminates are but variant embodiments of the present invention. Furthermore, the fibrous structure 20 according to the present invention may be perforated to cut without departure from the scope of the appended claims.

EXAMPLES

Given below are nonlimiting examples of two cellulosic fibrous structure 20' and 20. The examples show the basis weight differences and patterns formed thereby (or absence of patterns) in a cellulosic fibrous structure 20 according to the present invention and a cellulosic fibrous structure 20' according to the prior art.

Figure 8:
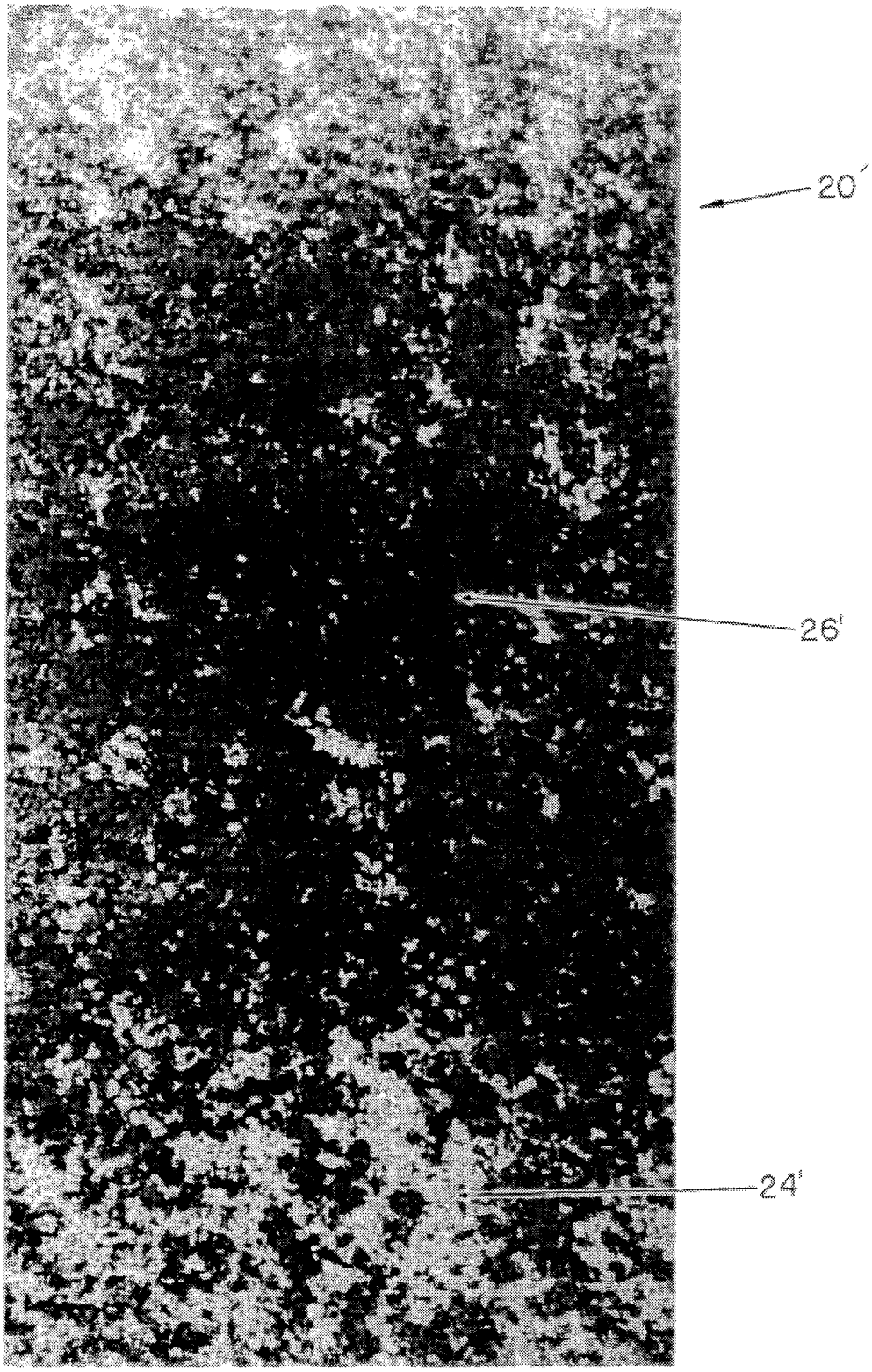
FIG. 8 PRIOR ART
FIG. 8 is a soft X-ray image plan view of a creped fibrous structure according to the prior art.

Referring to FIG. 8, shown is a plan view of a soft X-ray image of commercially available Bounty brand paper towel manufactured and sold by The Proctor and Gamble Company, of Cincinnati, Ohio. While the yellow, red, green and blue colors indicate different basis weights within the structure 20', a nonrandom, repeating pattern is not apparent.

The fibrous structure 20' of FIG. 8 has a field of view of about 8.66 centimeters by 8.66 centimeters (3.41 inches by 3.41 inches) and about 1,048,576 pixels within the field of view. A total of 1,048,547 nonzero value pixels, 29 zero value pixels, were present in the field of view. The actual mass of the sample, determined by weighing was 0.0573 grams. The calculated mass was 0.0576 grams, yielding an error 0.5 percent. The average basis weight was determined to be 10.94 pounds per 2,880 square feet with a standard deviation of 3.1 pounds per 2,880 square feet. The regression output had 4 degrees of freedom.

FIG. 9 is a soft X-ray image of the fibrous structure 20 illustrated in FIGS. 3A and 3B. Note that the nonrandom, repeating pattern of the discrete dark blue low basis weight regions 30 and 32 is apparent, indicating such low basis weight regions 30 and 32 have a lower basis weight than the circumjacent high basis weight regions 34 and 36 which appear principally yellow and red in color.

The sample of FIG. 9 has the same field of view and pixel density as the sample of FIG. 8. The sample of FIG. 9 has a actual mass of 0.073 grams, and a calculated mass of 0.072 grams for an error of less than 2 percent. The high basis weight regions 34 and 36 of FIG. 9 exhibit a total of 52,743 nonzero pixels, an average basis weight of 22.2 pounds per 2,880 square feet, and a standard deviation of 5.3 pounds per 2,880 square feet. The low basis weight regions 30 and 32 of FIG. 9 exhibit 35,406 nonzero pixels, an average basis weight of 8.5 pounds per 2,880 square feet and a standard deviation note 3.7 pounds per square feet. Between the low basis weight regions 30 and 32 and the high basis weight regions 34 and 36 are transition regions 33, which regions 33 exhibit a total of 3,128,290 pixels, an average basis weight of 16.1 pounds per 2,880 square feet (approximately midway between the average basis weights of the low basis weight regions 30 and 32 and the high basis weight regions 34 and 36) and a standard deviation of 5.5 pounds per 2,880 square feet.

Rationing the basis weight of the high basis weight regions 34 and 36 to the basis weight of the low basis weight regions 30 and 32, yields a value of 2.6. This ratio is greater than the approximately 1.33 minimum ratio (25 percent) judged necessary to determine the presence of a repeating pattern of differences in basis weights. A second area of interest (not shown) of the fibrous structure 20 from which the sample of FIG. 9 was taken shows the high basis weight regions 34 and 36 to have an average basis weight of 18.2 pounds per 2,880 square feet, the transitions regions to have a basis weight of 12.9 pounds per 2,880 square feet and the low basis weight regions 30 and 32 to have a basis weight of 5.8 pounds per 2,880 square feet. The ratio of the average of the basis weights of the high basis weight regions 34 and 36 to the average of the low basis weight regions 30 and 32 in the second area of interest is about 3.2.

It can be seen that the results obtained from either area of interest of the fibrous structure 20 according to the present invention, the area illustrated in FIG. 9 or the area not shown, produces surprisingly close correlation of results for the level of precision available in this type of measurement. This correlation of results lends creditability to the measurement technique.

FIG. 10 is an enlarged plan view of the fibrous structure 20 illustrated in FIG. 9. The high density regions 34 and 36 and the transition regions 33 between the high density regions 34 and 36 and the low density regions 30 and 32 are both masked. This masking leaves a very apparent nonrandom, repeating pattern of low basis weight regions 30 and 32. It can be seen that the low basis weight regions 30 or 32 be generally quivalent in shape to any other low basis weight region 30 and 32. Furthermore, it is not necessary that the discrete regions of the fibrous structure 20 be of low basis weight, only that a nonrandom, repeating pattern be present.

FIG. 11 is an enlarged plan view, similar to FIG. 10, of the structure of FIG. 9 masking both the low basis weight regions 30 and 32 and the high basis weight regions 34 and 36. Remaining are the transition regions 33 that divide and separate the low basis weight regions 30 and 32 from the high basis weight regions 34 and 36. As expected, the transition regions 33 circumscribe the low basis weight regions 30 and 32 and are distinct from the bilaterally staggered and adjacent transition regions 33.

FIG. 12 is an enlarged plan view similar to FIGS. 10 and 11, of the fibrous structure 20 of FIG. 9. The low basis weight regions 30 and 32 and transition regions 33 of FIG. 11 have been masked, leaving a continuous network of high basis weight regions 34 and 36. This leaves a very apparent nonrandom, repeating pattern of a continuous network of high basis weight regions 34 and 36 having voids where the low basis weight regions 30 and 32 and the transition regions 33 were masked. It is not necessary that any particular portion of the high basis weight regions 34 and 36 be quantitatively equivalent in basis weight to any other portion of the high basis weight regions 34 and 36, but only that a nonrandom, repeating pattern occur.

FIG. 13 is an enlarged plan view, similar to FIGS. 10–12, of the fibrous structure of FIG. 9 having the transition regions 33 which divide the low basis weight regions 30 and 32 from the high basis weight regions 34 and 36 masked. It is apparent that the generally mutually discrete blue appearing low basis weight regions 30 and 32 again form the repeating pattern of isolated bilaterally staggered regions amidst the continuous network of the high basis weight regions 34 or 36, which network appears yellow, green and red.

FIG. 14 is an enlarged plan view similar to FIGS. 10–13, of the structure of FIG. 9 illustrating all regions 30, 32, 34 and 36 without any masking. While it is apparent that with all regions 30, 32, 34 and 36 combined, the nonrandom, repeating pattern is present. The aid of isolating the transition regions 33 and using the aforementioned masking steps to separate the low basis weight regions 30 and 32 from the high basis weight regions 34 and 36 will assist one skilled in the art in determining when a nonrandom, repeating pattern occurs within the fibrous structure 20.

What is claimed is:

1. An apparatus for forming a cellulosic fibrous structure having at least three regions disposed in a regular repeating pattern and distinguished from each other by intensive properties, said apparatus comprising:

a macroscopically planar liquid pervious fiber retentive forming element, said forming element having two distance topographical regions, one of said regions being defined by a plurality of protuberances which are discrete from one another, said protuberances extending outwardly from said plane of said forming element and producing corresponding regions of a relatively lesser basis weight in said cellulosic fibrous structure than regions not corresponding to said outwardly extending protuberances;

a means for depositing a fibrous slurry on said forming element so that both said distinct topographical regions of said forming element receive deposition of said fibrous slurry, and wherein said fibrous slurry is dewatered into an embryonic fibrous structure having two different topographical regions corresponding to said distinct topographical regions of said forming element;

a through air drying means for applying a differential pressure to selected regions of said embryonic fibrous structure, said selected regions of said embryonic fibrous structure being non-coincident with said topographical regions of said embryonic fibrous structure formed by deposition of said fibrous slurry onto said forming element;

a means for transferring said embryonic fibrous structure from said forming element to said through air drying means for applying said differential pressure, said means for transferring said embryonic fibrous structure being juxtaposed with one of said forming element and said though air drying means;

a differential pressure cooperating member juxtaposed with said means for applying said differential pressure in order to resist the application of said differential pressure, and thereby cause densification of said selected regions of said embryonic fibrous structure; and a means for drying said embryonic fibrous structure, said means for drying being juxtaposed with said through air drying means.

2. An apparatus according to claim 1 wherein said forming element is an endless belt.

3. An apparatus according to claim 1 wherein said means for applying said differential pressure is an endless belt.

4. An apparatus according to claim 3 wherein said at least one protuberance comprises a photosensitive resin.

5. An apparatus according to claim 1 wherein said differential pressure cooperating member has vacuum pervious regions noncoincident said topographical regions of said forming element.

6. An apparatus according to claim 5 wherein said differential pressure cooperating member is a second endless belt.

* * * * *

UNITED STATES PATENT AND TRADEMARK OFFICE

CERTIFICATE OF CORRECTION

PATENT NO. : 5,614,061

DATED : March 25, 1997

INVENTOR(S) : DEAN V. PHAN ET AL.

It is certified that error appears in the above-identified patent and that said Letters Patent is hereby corrected as shown below:

Cover sheet, Title, "STRUCTURES" should read – STRUCTURE --.

Cover sheet, under FOREIGN PATENT DOCUMENTS, add – WO 91/02642 3/91 --.

Column 1, line 17, after "distinguished" insert – by intensive properties, and more particularly and typically to paper having three or more regions distinguished --.

Column 1, line 56, "25,," should read – 25, --.

Column 2, line 49, delete "the", second occurrence.

Column 3, line 6, insert after "mutually" – different --.

Column 3, line 38, "lest" should read – least --.

Column 4, line 62, "wherein" should read – therein --.

Column 5, line 29, "transition" should read – low basis weight --.

Column 5, line 42, "opposite side of the" should read – face of a creped --.

Column 6, line 3, "a", second occurrence, should read – as --.

Column 6, line 23, "coinferous" should read – coniferous --.

Column 6, line 37, "26°" should read – 26' --.

Column 6, line 37, "having" should read – have --.

Column 6, line 65, "of" should read – to --.

Column 6, line 66, "regions" should read – region --.

Column 7, line 28, "the" should read – and -- .

Column 7, line 55, "lest" should read – least --.

Column 8, line 11, "weight" should read – weights --.

Column 9, line 43, after "or" insert – a --.

UNITED STATES PATENT AND TRADEMARK OFFICE

CERTIFICATE OF CORRECTION

PATENT NO. : 5,614,061

DATED : March 25, 1997

INVENTOR(S) : DEAN V. PHAN ET AL.

It is certified that error appears in the above-identified patent and that said Letters Patent is hereby corrected as shown below:

Column 9, line 50, "only the" should read – only that --.

Column 9, line 59, "recognizing the" should read – recognizing that --.

Column 12, line 31, "Z6" should read – 26 --.

Column 13, line 10, "network" should read – network, --.

Column 13, line 38, "distance" should read – distinct --.

Column 13, line 41, "that" should read – than --.

Column 16, line 5, "describe" should read – described --.

Column 16, line 9, "weighted on a" should read – weighed on an --.

Column 16, line 11, "Dupont" should read – DuPont --.

Column 16, line 13, "places" should read – placed --.

Column 16, line 44, "of" should read – the --.

Column 16, line 59, "Transission" should read – Transmission --.

Column 16, line 64, "covert" should read – convert --.

Column 18, line 38, "for" should read – four --.

Column 20, line 12, "pringer/plotter" should read – printer/plotter --.

Column 20, line 22, "imagining" should read – imaging --.

Column 20, lines 26-27, "difference" should read – differences --.

Column 20, line 40, "™8800" should read -- #8800 --.

Column 20, line 48, "diviations" should read – deviations --.

Column 21, line 25, "ato" should read – to --.

Column 21, line 55, "millimeter" should read – millimeters --.

Column 21, line 63, "Specta" should read – Spectra --.

UNITED STATES PATENT AND TRADEMARK OFFICE

CERTIFICATE OF CORRECTION

PATENT NO. : 5,614,061

DATED : March 25, 1997

INVENTOR(S) : DEAN V. PHAN ET AL.

It is certified that error appears in the above-identified patent and that said Letters Patent is hereby corrected as shown below:

Column 22, line 18, "corresponding" should read -- correspond --.

Column 22, line 56, after "the" insert – following thicknesses are measured. The sample is mounted on the --.

Column 23, line 31, "form" should read – from --.

Column 23, line 55, after "sample" insert – measuring approximately 2 centimeters by approximately 6 --.

Column 23, line 60, "tis" should read – this --.

Column 24, line 18, "require" should read – acquire --.

Column 24, line 66, "™1-t" should read -- #1-T --.

Column 25, line 33, "filed." should read – field. --.

Column 25, line 39, "of" should read – on --.

Column 26, line 38, "$R_{66}$", both occurrences, should read -- RΔ. --.

Column 27, line 1, after "convenience" insert – in --.

Column 27, line 26, after "found" delete "i" and insert therefor –in --.

Column 27, line 35, "cut the" should read – cut and --.

Column 27, line 57, "lest" should read – least --.

Column 28, line 13, "providing the" should read – providing a --.

Column 29, line 5, "lest" should read – least --.

Column 29, line 12, "of" should read – or --.

Column 29, line 33, "of the" should read – of time --.

Column 29, line 67, "patters." should read – patterns. --.

Column 30, line 15, "contacts the" should read – contacts at --.

UNITED STATES PATENT AND TRADEMARK OFFICE

CERTIFICATE OF CORRECTION

PATENT NO. : 5,614,061

DATED : March 25, 1997

INVENTOR(S) : DEAN V. PHAN ET AL.

It is certified that error appears in the above-identified patent and that said Letters Patent is hereby corrected as shown below:

Column 30, line 40, "with the" should read – with and --.

Column 31, line 24, "extend" should read – extent --.

Column 31, line 60, "fee" should read – free --.

Column 31, line 65, after "may" insert – be --.

Column 33, line 2, "applied" should read – applies --.

Column 33, line 23, "infra-rad" should read – infra-red --.

Column 33, line 23, "below-through" should read – blow-through --.

Column 34, line 26, "member" should read – members --.

Column 34, line 52, "36" should read – 26 --.

Column 36, line 40, "juxtapose" should read – juxtaposed --.

Column 37, line 17, delete "(of" and insert therefor – (or --.

Column 37, line 23, "of the" should read – to the --.

Column 37, line 39, "fur" should read – four –.

Column 37, line 60, "illustrated i" should read – illustrated in --.

Column 38, line 4, "20." Should read – 20, --.

Column 38, line 20, "stop" should read – step --.

Column 38, line 62, "Cynamid" should read – Cyanamid --.

Column 39, line 32, "20'0" should read – 20' --.

Column 39, line 37, "to" should read – or --.

Column 39, line 50, "Proctor" should read – Procter --.

Column 40, line 24, "Rationing" should read – Ratioing --.

UNITED STATES PATENT AND TRADEMARK OFFICE

CERTIFICATE OF CORRECTION

PATENT NO. : 5,614,061

DATED : March 25, 1997

INVENTOR(S) : DEAN V. PHAN ET AL.

It is certified that error appears in the above-identified patent and that said Letters Patent is hereby corrected as shown below:

Column 40, line 54, after "30" insert – and 32 are mutually discrete and biaxially staggered. It is not necessary, however, that each low basis weight region 30 --.

Column 41, line 41, "distance" should read – distinct --.

Column 42, line 22, "though" should read – through --.

Signed and Sealed this

Twentieth Day of October, 1998

*Attest:*

*Attesting Officer*

Bruce Lehman

BRUCE LEHMAN

*Commissioner of Patents and Trademarks*